US009046823B2

(12) United States Patent
Satomura et al.

(10) Patent No.: US 9,046,823 B2
(45) Date of Patent: Jun. 2, 2015

(54) DEVELOPER ACCOMMODATING CONTAINER AND PROCESS CARTRIDGE

(71) Applicant: CANON KABUSHIKI KAISHA, Tokyo (JP)

(72) Inventors: Shogo Satomura, Kawasaki (JP); Makoto Hayashida, Numazu (JP); Akira Suzuki, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 13/670,952

(22) Filed: Nov. 7, 2012

(65) Prior Publication Data

US 2013/0129377 A1 May 23, 2013

(30) Foreign Application Priority Data

| | | |
|---|---|---|
| Nov. 9, 2011 | (JP) | 2011-245732 |
| Nov. 9, 2011 | (JP) | 2011-245735 |
| Dec. 12, 2011 | (JP) | 2011-271209 |
| Nov. 5, 2012 | (JP) | 2012-243708 |

(51) Int. Cl.
*G03G 15/08* (2006.01)
*G03G 21/18* (2006.01)

(52) U.S. Cl.
CPC ..... *G03G 15/0898* (2013.01); *G03G 15/0881* (2013.01); *G03G 21/1832* (2013.01); *G03G 21/18* (2013.01)

(58) Field of Classification Search
CPC ..... G03G 15/0898; G03G 15/0881
USPC ..... 399/106, 102, 103, 105
See application file for complete search history.

(56) References Cited

U.S. PATENT DOCUMENTS

| | | | | |
|---|---|---|---|---|
| 5,697,021 | A * | 12/1997 | Watanabe et al. | 399/102 |
| 5,946,530 | A * | 8/1999 | Tsuji et al. | 399/103 |
| 5,966,567 | A | 10/1999 | Matsuzaki et al. | |
| 6,104,894 | A * | 8/2000 | Sato et al. | 399/106 |
| 6,144,815 | A | 11/2000 | Chadani et al. | |
| 6,154,623 | A | 11/2000 | Suzuki et al. | |
| 6,173,140 | B1 | 1/2001 | Suzuki et al. | |
| 6,173,145 | B1 | 1/2001 | Chadani et al. | |
| 6,205,305 | B1 | 3/2001 | Suzuki et al. | |
| 6,219,504 | B1 | 4/2001 | Matsuzaki et al. | |
| 6,246,853 | B1 | 6/2001 | Suzuki et al. | |

(Continued)

FOREIGN PATENT DOCUMENTS

| | | |
|---|---|---|
| JP | 2003015391 A | 1/2003 |
| JP | 2003162149 | 6/2003 |
| JP | 2004353764 A | 12/2004 |

OTHER PUBLICATIONS

PCT International Search Report in Search Report Application No. PCT/JP2012/079576, dated Feb. 5, 2013.

*Primary Examiner* — Rodney Bonnette
(74) *Attorney, Agent, or Firm* — Fitzpatrick, Cella, Harper & Scinto

(57) ABSTRACT

A developer accommodating container for accommodating a developer, includes: a frame provided with a hole; a rotatable member penetrating the hole; and a seal member, provided on the frame by injection molding, for sealing a gap between a circumference of the hole of the frame and an outer peripheral surface of the rotatable member to prevent the developer from leaking out of the developer accommodating container. The seal member includes a projected portion which projects toward an inside of the hole and contacts the outer peripheral surface of the rotatable member.

33 Claims, 17 Drawing Sheets

(56) References Cited

U.S. PATENT DOCUMENTS

| | | | | |
|---|---|---|---|---|
| 6,282,389 | B1 | 8/2001 | Matsuzaki et al. | |
| 6,415,121 | B1 | 7/2002 | Suzuki et al. | |
| 6,480,686 | B2 * | 11/2002 | Hilbert et al. | 399/103 |
| 6,498,914 | B2 * | 12/2002 | Hashimoto et al. | 399/103 |
| 6,549,736 | B2 | 4/2003 | Miyabe et al. | |
| 6,654,578 | B2 | 11/2003 | Suzuki et al. | |
| 6,771,920 | B2 | 8/2004 | Abe et al. | |
| 6,795,666 | B2 | 9/2004 | Miyabe et al. | |
| 6,868,243 | B2 | 3/2005 | Watanabe et al. | |
| 6,931,226 | B2 | 8/2005 | Chadani et al. | |
| 6,934,485 | B2 | 8/2005 | Miyabe et al. | |
| 7,099,607 | B2 | 8/2006 | Suzuki et al. | |
| 7,366,439 | B2 | 4/2008 | Anan et al. | |
| 7,933,534 | B2 | 4/2011 | Hoshi et al. | |
| 8,126,357 | B2 | 2/2012 | Satomura | |
| 2009/0245851 | A1 | 10/2009 | Hoshi et al. | |
| 2010/0129110 | A1 * | 5/2010 | Kawaguchi | 399/104 |
| 2011/0170903 | A1 | 7/2011 | Hoshi et al. | |
| 2013/0022368 | A1 | 1/2013 | Takarada et al. | |
| 2013/0114972 | A1 | 5/2013 | Takarada et al. | |
| 2013/0121720 | A1 | 5/2013 | Hoshi et al. | |
| 2013/0129375 | A1 | 5/2013 | Yamasaki et al. | |
| 2013/0142541 | A1 | 6/2013 | Hayashida | |
| 2013/0170851 | A1 | 7/2013 | Takarada et al. | |

* cited by examiner (a)

(b)

(a)

(b)

(a)

(b)

DEVELOPER ACCOMMODATING CONTAINER AND PROCESS CARTRIDGE

FIELD OF THE INVENTION AND RELATED ART

The present invention relates to a developer accommodating container and a process cartridge including the developer accommodating container.

A conventional developer accommodating container in which a rotatable member such as a toner stirring member or a driving shaft for transmitting a rotational driving force to the toner stirring member is inserted into a hole provided in a frame of the developer accommodating container which accommodates a developer (toner) has been known. In such a developer accommodating container, a constitution using a seal member for sealing a ring-like gap (spacing) between the frame (hole) and the rotatable member has been used and known (Japanese Laid-Open Patent Application (JP-A) 2003-162149). For example, a technique such that a toner seal (generally used as an oil seal) is press-fitted into a circumference of the hole of the frame to seal the ring-like gap between the inner peripheral surface of the frame and an outer peripheral surface of the driving shaft has been known. This toner seal is provided with a projected portion slidably contacting the outer peripheral surface of the driving shaft, and an end of the projected portion has a predetermined penetration depth (amount) with respect to the outer peripheral surface of the driving shaft to seal the ring-like gap (JP-A 2003-162149).

However, in the constitution in which the toner seal is press-fitted into the hole, a locating position of the toner seal is low in accuracy or the toner seal is tilted and thus a mounted state of the toner seal is not stabilized. For that reason, there arises a problem that a sealing performance is unstable.

SUMMARY OF THE INVENTION

A principal object of the present invention is to provide a developer accommodating container and a process cartridge which are improved in stability of a sealing performance.

According to an aspect of the present invention, there is provided a developer accommodating container for accommodating a developer, comprising: a frame provided with a hole; a rotatable member penetrating the hole; and a seal member, provided on the frame by injection molding, for sealing a gap between a circumference of the hole of the frame and an outer peripheral surface of the rotatable member to prevent the developer from leaking out of the developer accommodating container, wherein the seal member includes a projected portion which projects toward an inside of the hole and contacts the outer peripheral surface of the rotatable member.

According to another aspect of the present invention, there is provided a developer accommodating container for accommodating a developer, comprising: a frame provided with a hole; a rotatable member penetrating the hole; and a seal member, provided on the rotatable member by injection molding, for sealing a gap between a circumference of the hole of the frame and an outer peripheral surface of the rotatable member to prevent the developer from leaking out of the developer accommodating container, wherein the seal member includes a projected portion which projects from the outer peripheral surface of the rotatable member and contacts the circumference of the hole of the frame.

According to another aspect of the present invention, there is provided a process cartridge detachably mountable to an image forming apparatus, comprising: (i) a photosensitive member; (ii) a developing member for developing an electrostatic latent image, formed on the photosensitive member, with a developer; and (iii) a developer accommodating container for accommodating the developer, the developer accommodating container comprising: a frame provided with a hole; a rotatable member penetrating the hole; and a seal member, provided on the frame by injection molding, for sealing a gap between a circumference of the hole of the frame and an outer peripheral surface of the rotatable member to prevent the developer from leaking out of the developer accommodating container, wherein the seal member includes a projected portion which projects toward an inside of the hole and contacts the outer peripheral surface of the rotatable member.

According to a further aspect of the present invention, there is provided a process cartridge detachably mountable to an image forming apparatus, comprising: (i) a photosensitive member; (ii) a developing member for developing an electrostatic latent image, formed on the photosensitive member, with a developer; and (iii) a developer accommodating container for accommodating the developer, developer accommodating container comprising: a frame provided with a hole; a rotatable member penetrating the hole; and a seal member, provided on the rotatable member by injection molding, for sealing a gap between a circumference of the hole of the frame and an outer peripheral surface of the rotatable member to prevent the developer from leaking out of the developer accommodating container, wherein the seal member includes a projected portion which projects from the outer peripheral surface of the rotatable member and contacts the circumference of the hole of the frame.

These and other objects, features and advantages of the present invention will become more apparent upon a consideration of the following description of the preferred embodiments of the present invention taken in conjunction with the accompanying drawings.

Figure 7:
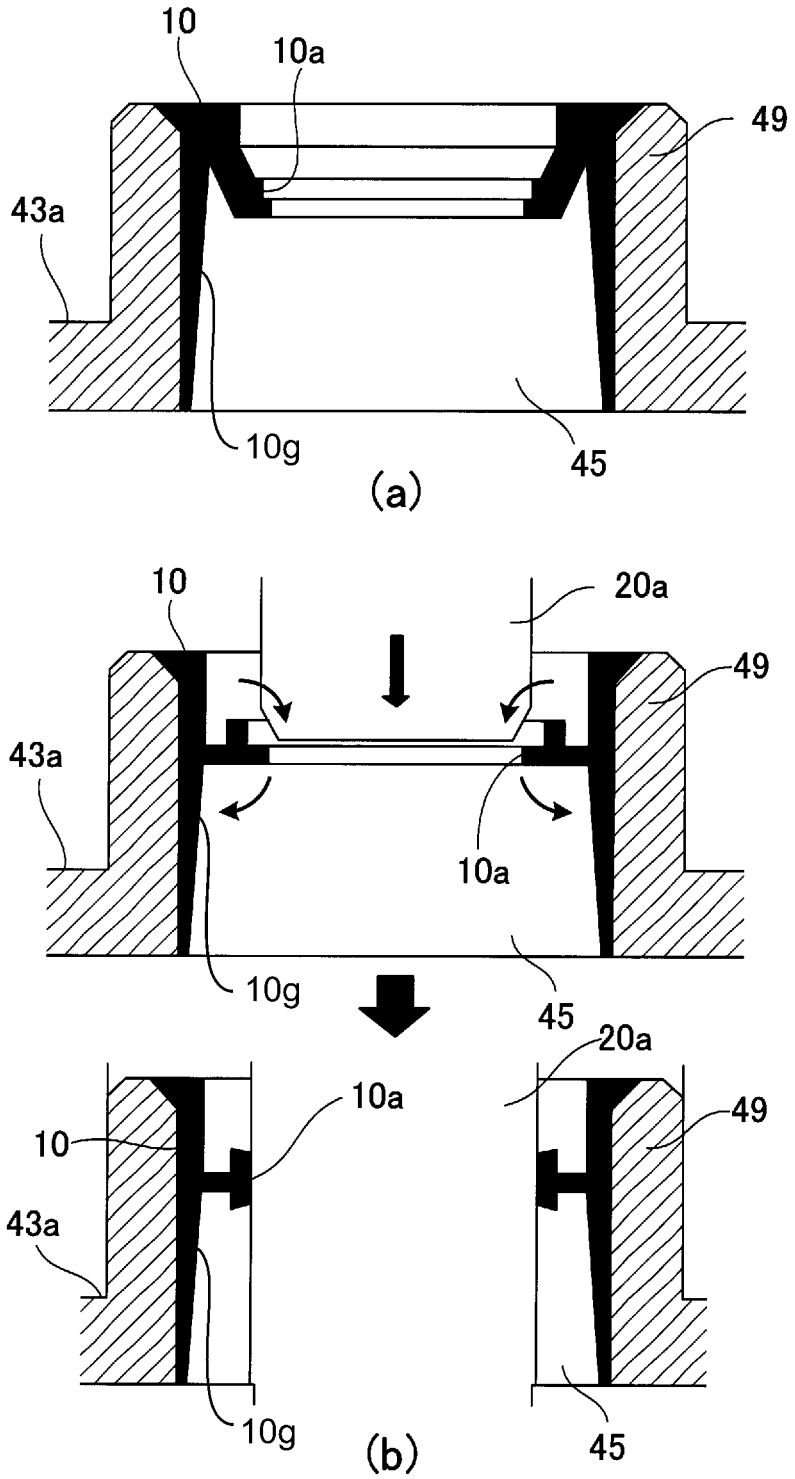

Parts (a) and (b) of FIG. 7 are schematic sectional views each showing an example of a shape of a projected portion of a seal member.

Figure 8:
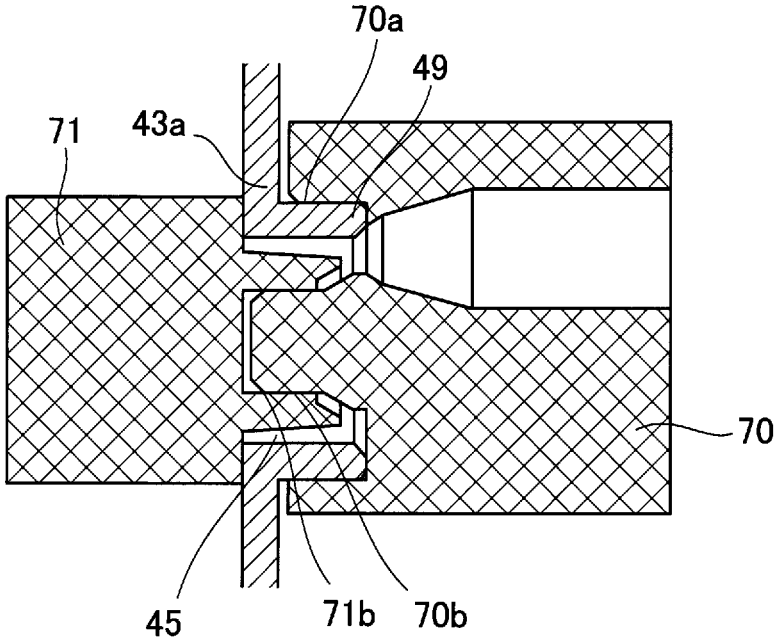
Figure 8:
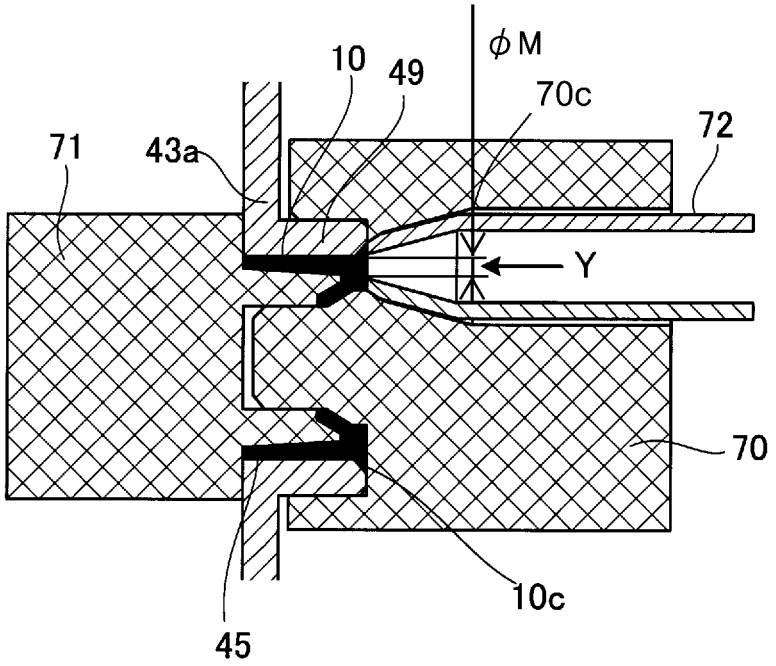

Parts (a) and (b) of FIG. 8 are schematic sectional views showing a state in which a molding metal mold is clamped on a toner accommodating container in Embodiment 1.

Figure 9:
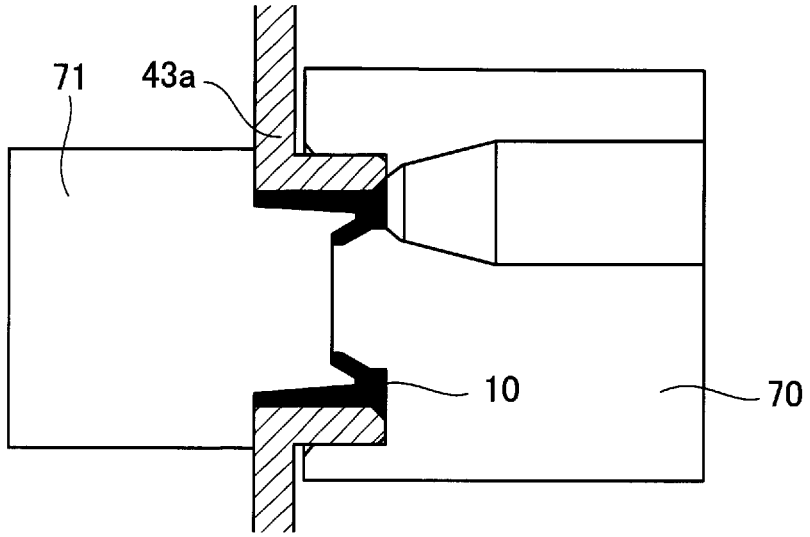
Figure 9:
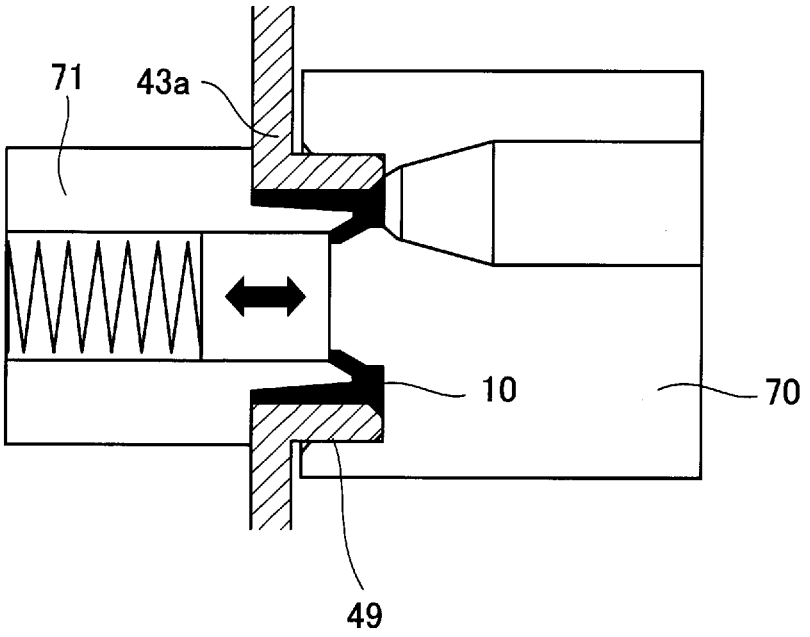

Parts (a) and (b) of FIG. 9 are schematic sectional views of the molding metal mold for molding the seal member.

Figure 10:
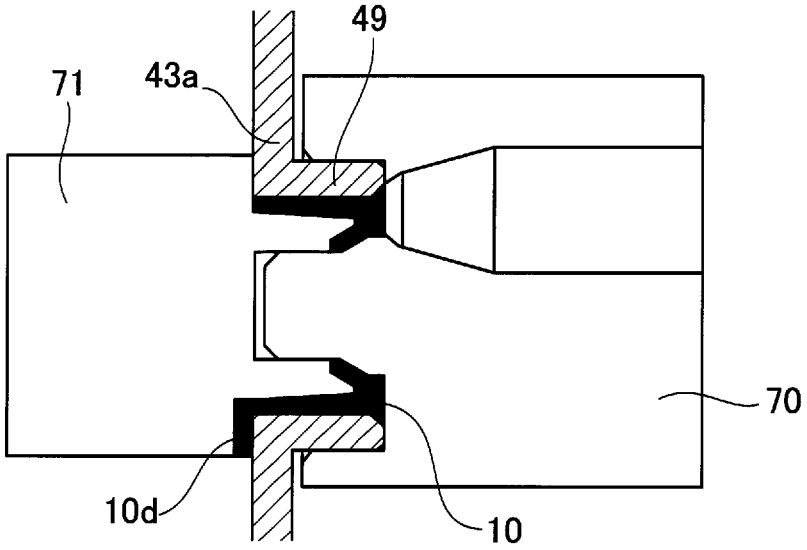

FIG. 10 is a schematic sectional view of the seal member stabilized in molded state.

Figure 11:
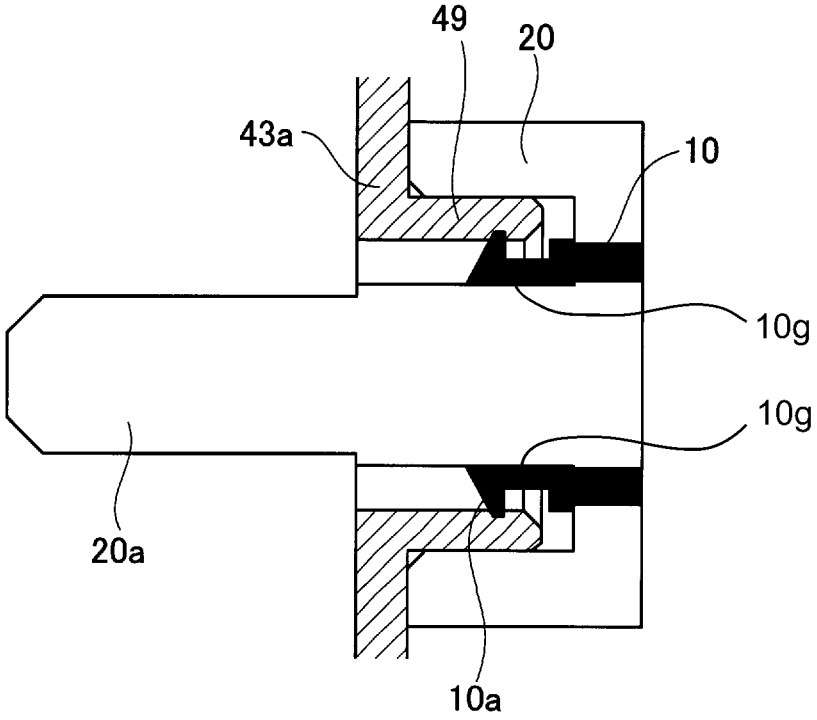

FIG. 11 is a schematic sectional view showing a seal structure in Embodiment 2.

Figure 12:
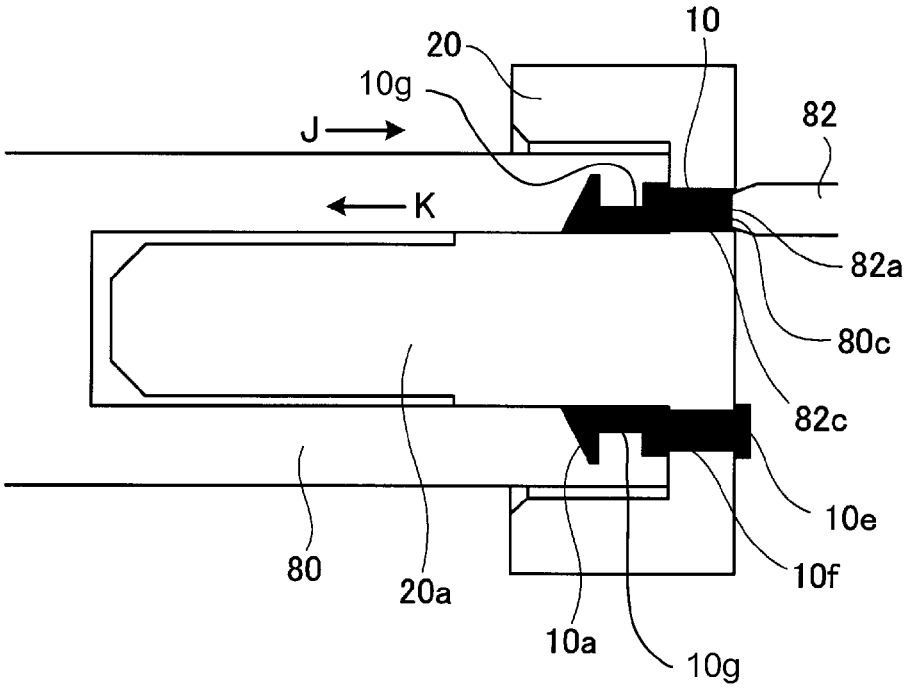

FIG. 12 is a schematic sectional view for illustrating a molding process of the seal member in Embodiment 2.

Figure 13:
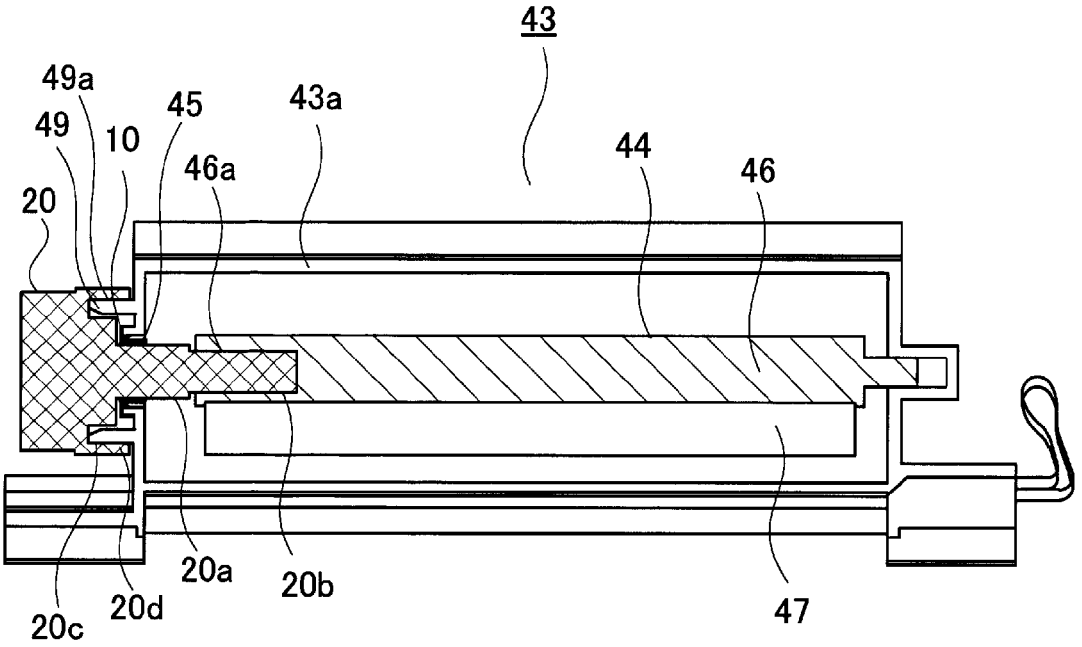

FIG. 13 is a schematic sectional view showing a structure of a toner accommodating container in Embodiment 3.

Figure 14:
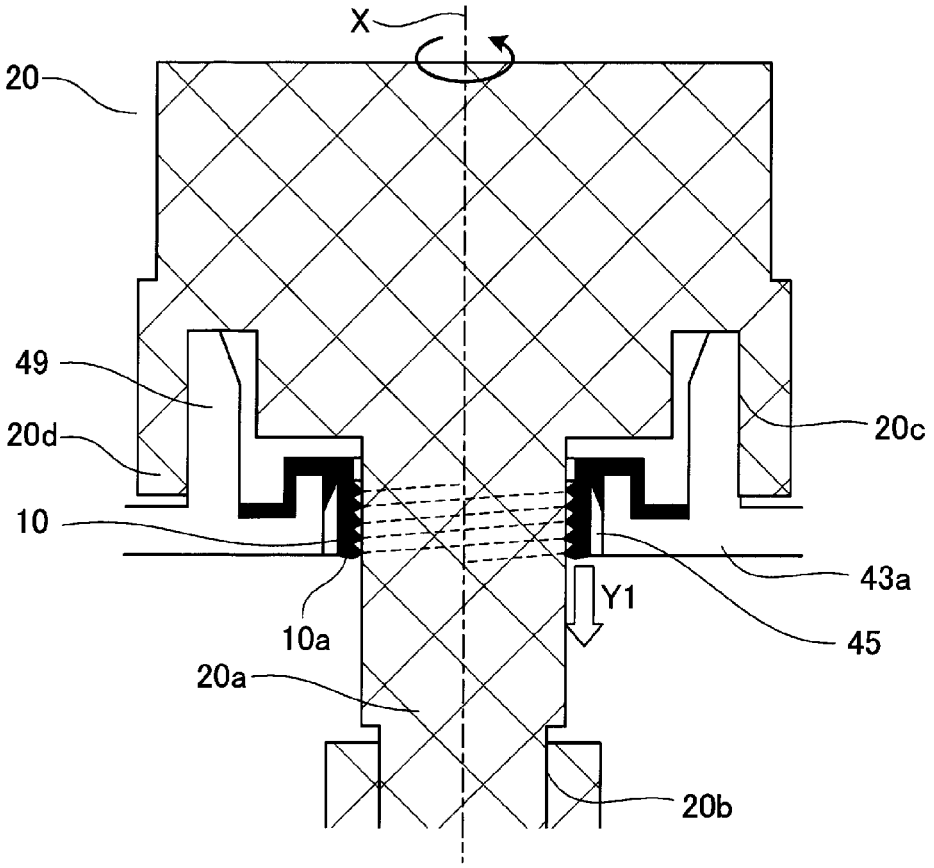

FIG. 14 is a schematic sectional view showing a seal structure in Embodiment 3.

Figure 15:
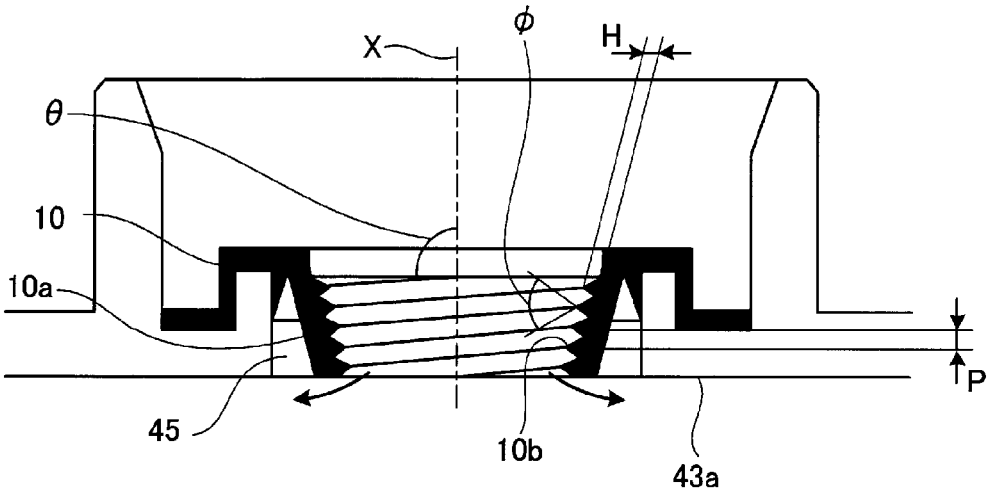

FIG. 15 is a schematic sectional view showing the seal structure before a driving shaft is inserted in Embodiment 3.

Figure 16:
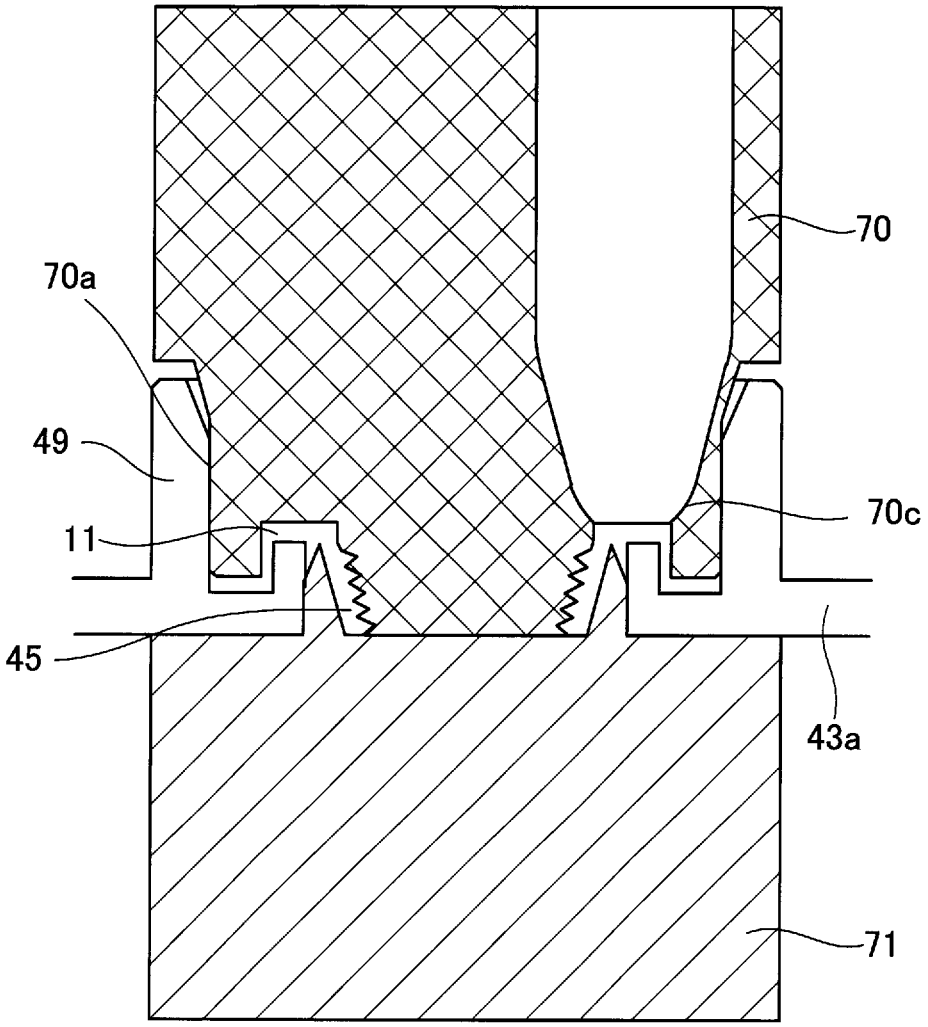

FIG. 16 is a schematic sectional view showing a state in which a molding metal mold is clamped on the toner accommodating container in Embodiment 3.

Figure 17:
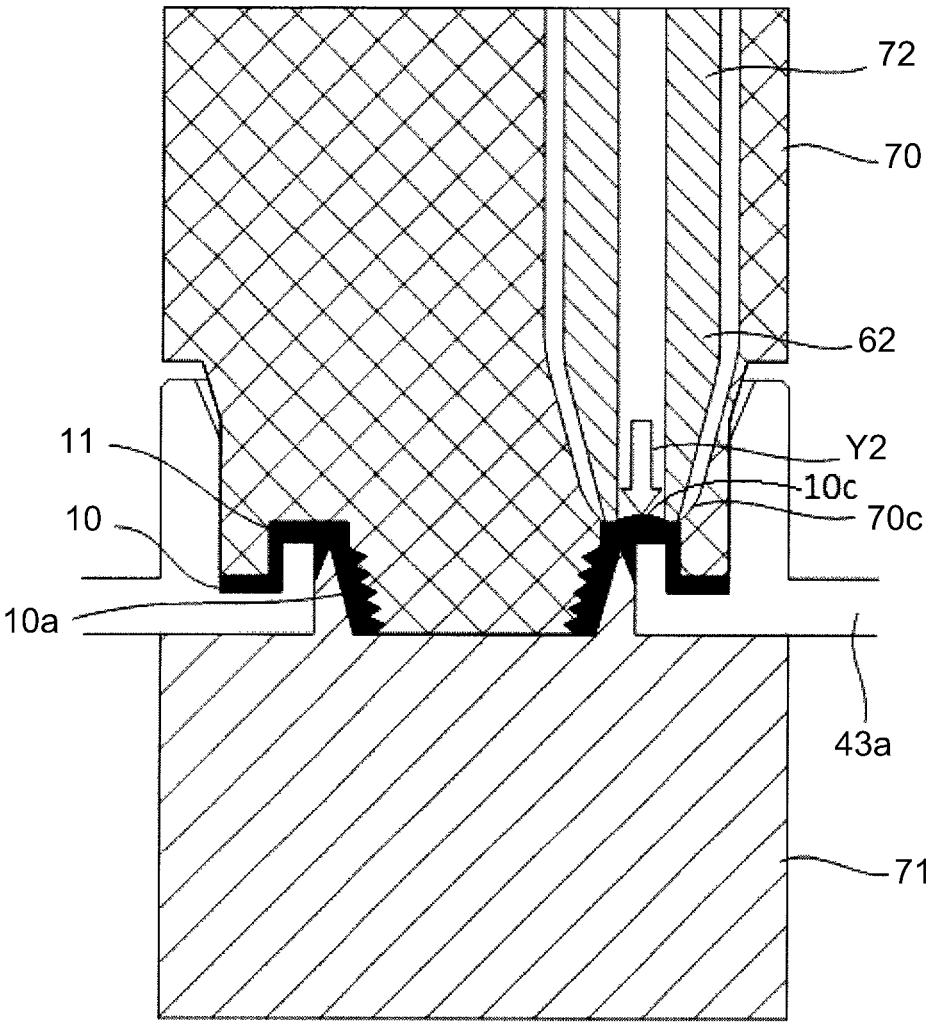

FIG. 17 is a schematic sectional view of the seal member during molding in Embodiment 3.

Figure 18:
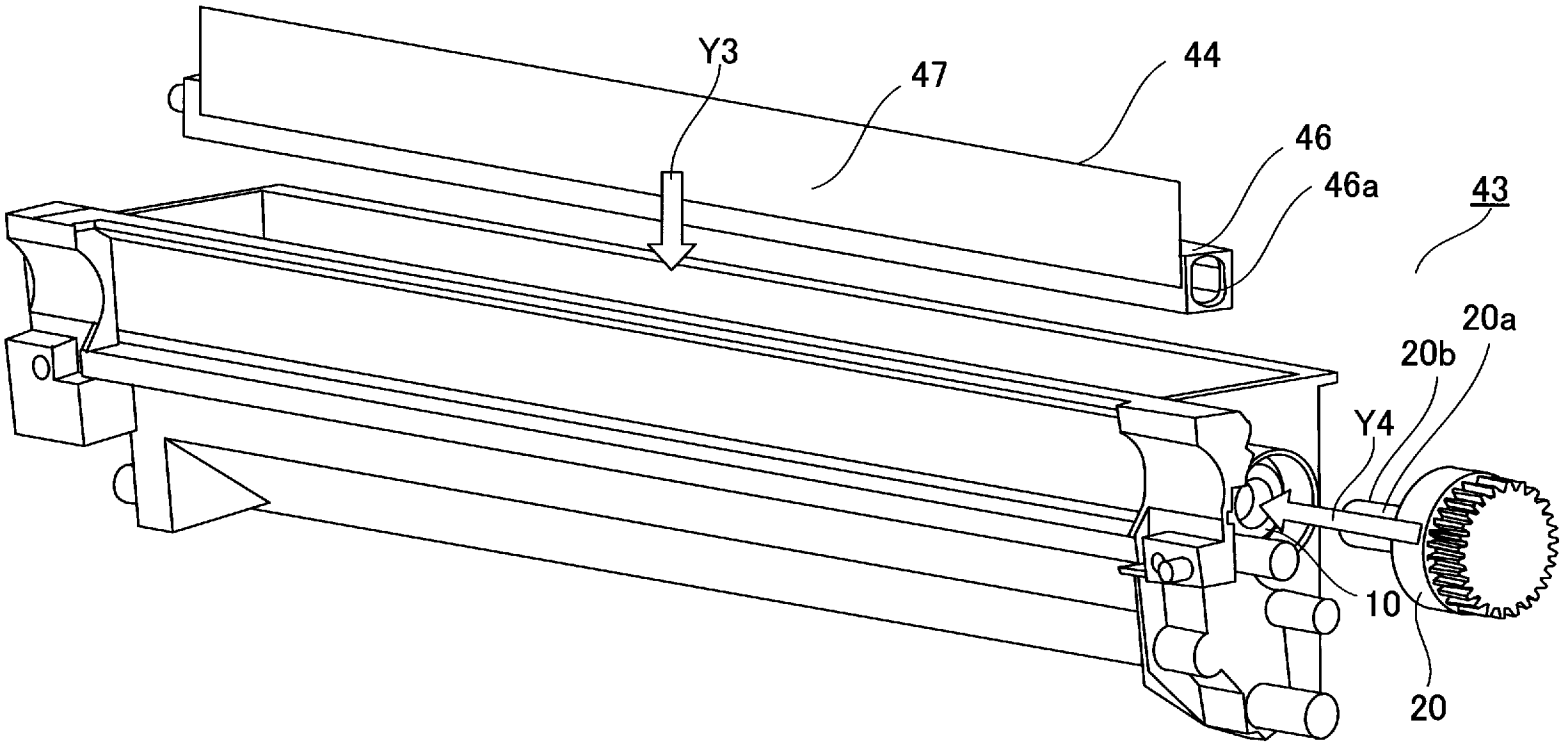

FIG. 18 is an exploded perspective view showing a state in which a toner stirring unit and a driving member are assembled.

Figure 19:
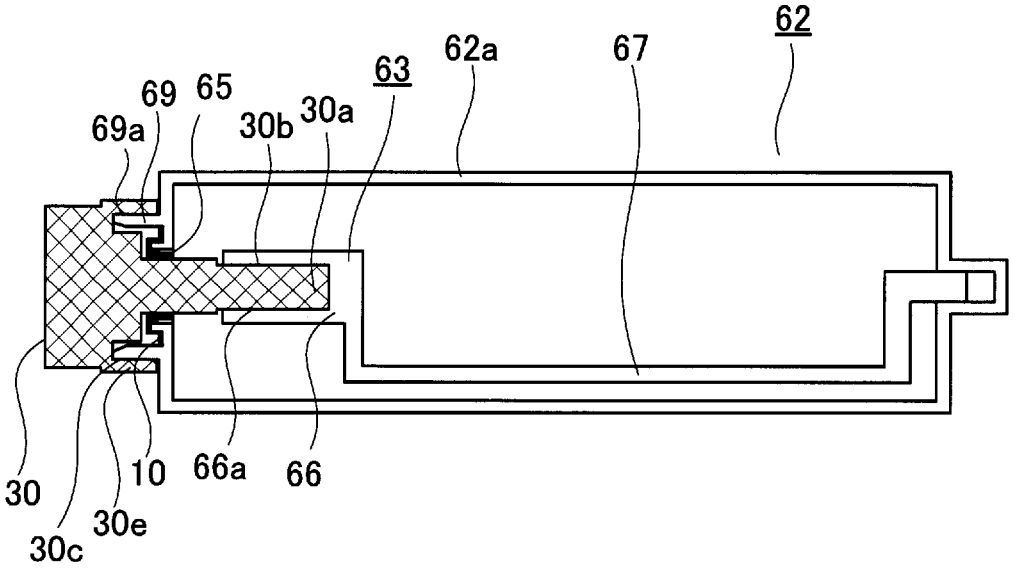

FIG. 19 is a schematic sectional view showing a structure of a residual toner container in Embodiment 4.

Figure 20:
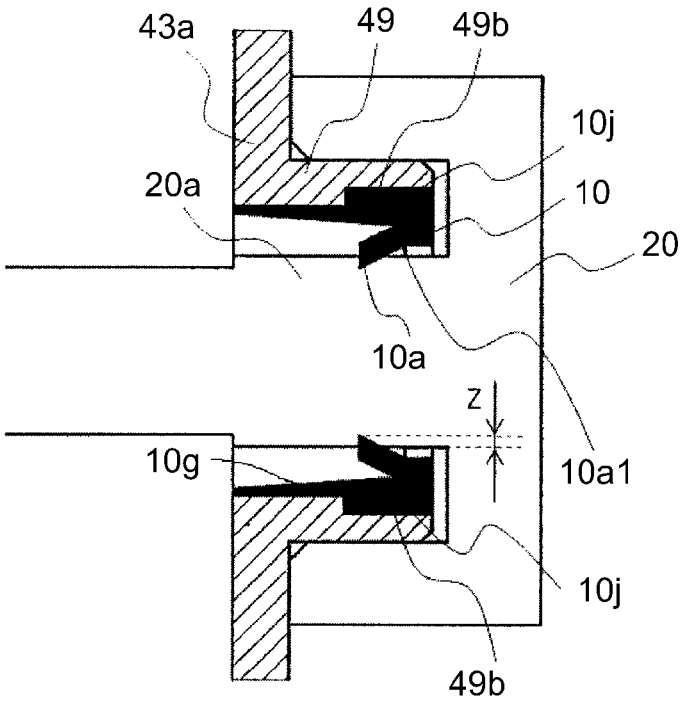
Figure 20:
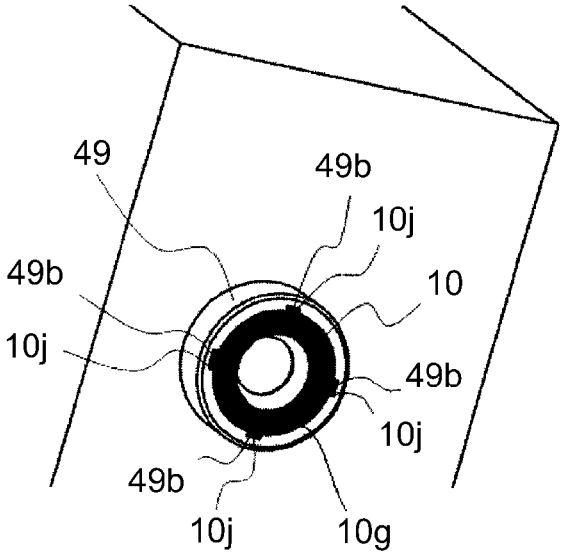

Parts (a) and (b) of FIG. 20 are a schematic sectional view and a schematic perspective view, respectively, of a seal structure in Embodiment 5.

Figure 21:
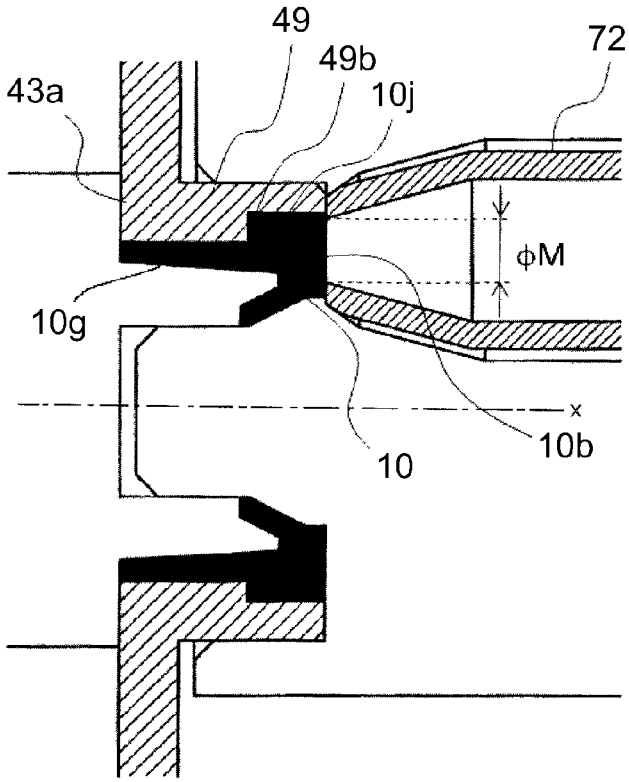

FIG. 21 is a schematic sectional view of the seal structure in Embodiment 5.

Figure 22:
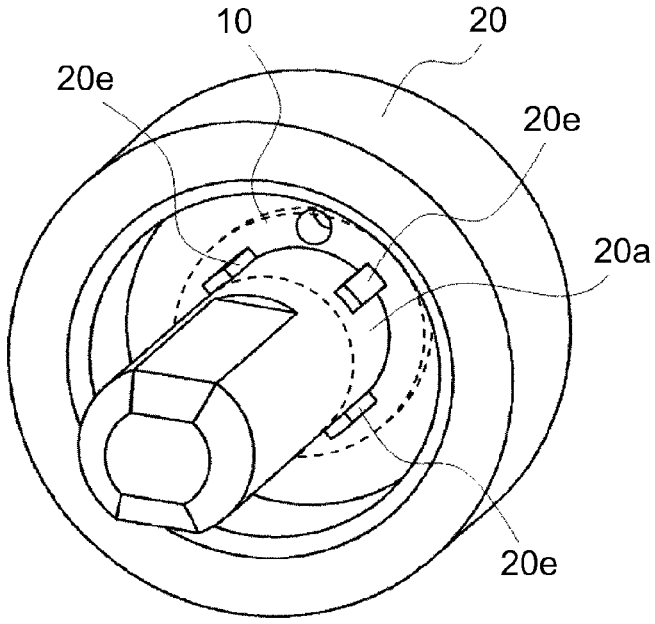

FIG. 22 is a schematic perspective view of the seal structure in Embodiment 5.

DESCRIPTION OF THE PREFERRED EMBODIMENTS

Figure 1:
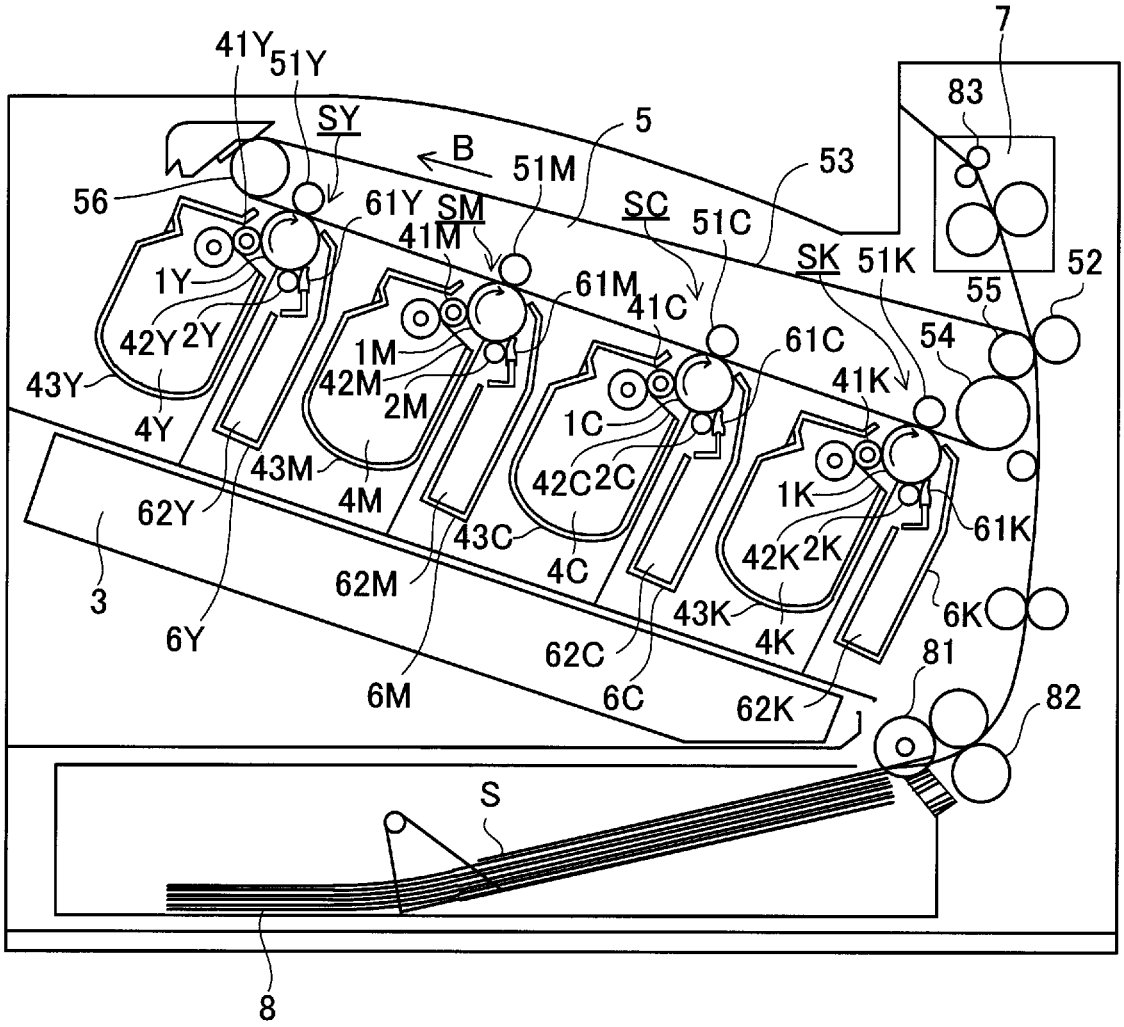
FIG. 1 is a schematic sectional view of a general structure of an image forming apparatus according to an embodiment of the present invention.

First, with reference to FIG. 1, a general structure of an image forming apparatus in an embodiment of the present invention will be described. FIG. 1 is a schematic sectional view showing the general structure of the image forming apparatus in the embodiment of the present invention. In this embodiment, as an example of the image forming apparatus, a full-color laser beam printer of an in-line type and an intermediary transfer type will be described. However, the present invention is not limited thereto but may also be applicable to other image forming apparatuses such as a monochromatic printer, a copying machine, and a facsimile machine.

The image forming apparatus in this embodiment includes, as a plurality of image forming portions, image forming portions SY, SM, SC and SK for forming images of yellow (Y), magenta (M), cyan (C) and black (K), respectively. Structures and operations of the respective image forming portions are substantially the same except that the colors of the images to be formed are different from each other. Therefore, in the case where elements (parts) are not particularly differentiated, suffixes Y, M, C and K added to reference numerals or symbols for representing the elements for the respective colors will be omitted from description. Further, dimensions, materials, shapes, relative arrangements, and the like of constituent elements described in this and subsequent embodiments are not intended to limit the scope of the present invention only thereto unless otherwise specified.

As shown in FIG. 1, the image forming apparatus in this embodiment includes, as principal constituent elements, a photosensitive drum 1, a charging roller 2, an exposure device 3, a developing device 4, a transfer device 5, a cleaning device 6 and a fixing device 7.

The developing device 4 includes a developing roller 41 as a developing member, a developing blade 42, and a toner accommodating container 43 as a developer accommodating container. The toner accommodating container 43 accommodates a toner as a non-magnetic one-component developer and includes a toner stirring unit 44 (FIG. 3) for stirring and feeding the toner. The developing roller 41 is rotatably supported by the toner accommodating container 43. The developing blade 42 for regulating a layer thickness of the toner carried on the developing roller 41 and is fixed on the toner accommodating container 43, and is provided in contact with the developing roller 41.

The transfer device 5 includes, as principal constituent elements, a primary transfer roller 51, a secondary transfer roller 52 and an intermediary transfer belt 53. The intermediary transfer belt 53 is formed by an endless belt and is provided in contact with all the photosensitive drums 1Y, 1M, 1C and 1K. Further, the intermediary transfer belt 53 is supported by and extended around a driving roller 54, a secondary transfer opposite roller 55 and a follower roller 56, and is circulated and moved in an arrow B direction in FIG. 1. Further, primary transfer rollers 51Y, 51M, 51C and 51K are juxtaposed on an inner peripheral surface of the intermediary transfer belt 53 so as to sandwich the belt 53 themselves and the photosensitive drums 1Y, 1M, 1C and 1K.

The cleaning device 6 includes a cleaning blade 61 for removing the toner remaining on the photosensitive drum 1, and a residual toner container 62 as a developer accommodating container for accommodating the removed toner. The cleaning blade 61 is provided in contact with the photosensitive drum 1.

Figure 2:
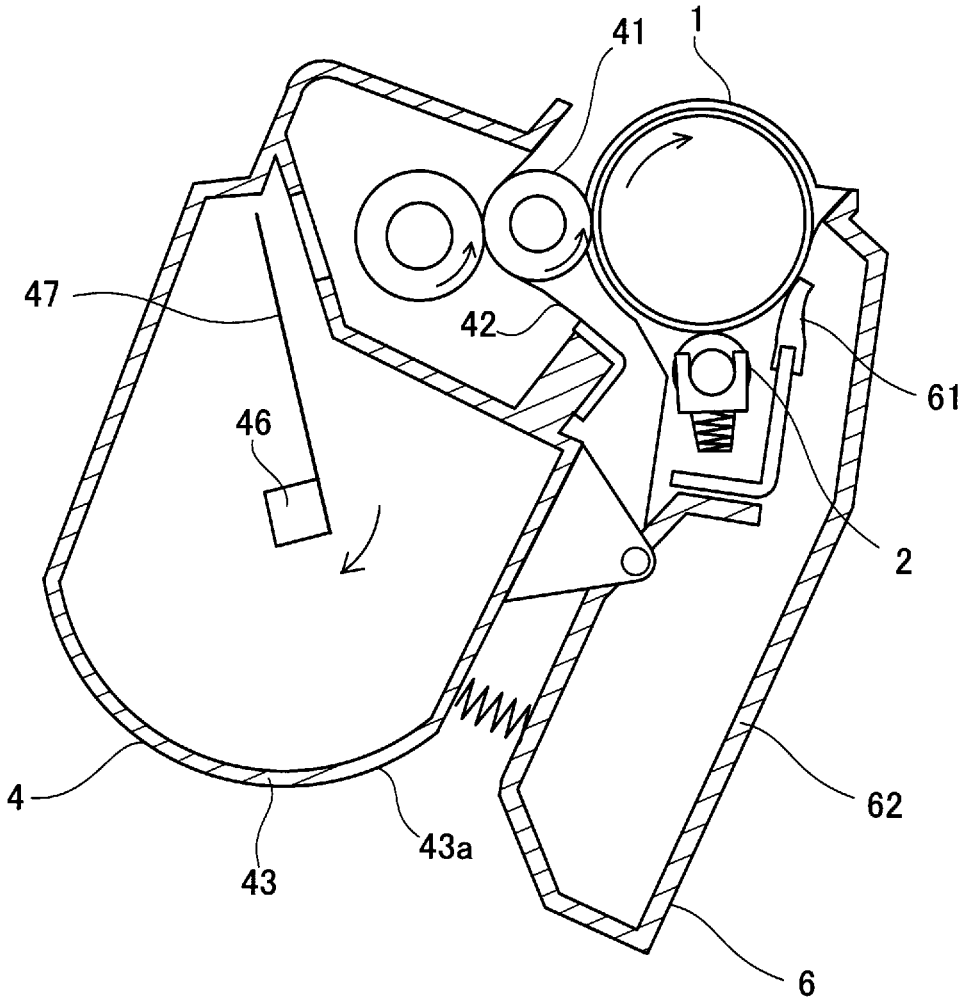
FIG. 2 is a schematic sectional view of a process cartridge in the embodiment.

Next, with reference to FIG. 2, a process cartridge according to this embodiment of the present invention will be described. FIG. 2 is a schematic sectional view of the process cartridge in this embodiment. In this embodiment, the photosensitive drum 1, the charging roller 2, the developing device 4 and the cleaning device 6 are integrally assembled into a cartridge to form the process cartridge. The process cartridge is detachably mountable to a main assembly of the image forming apparatus via mounting means such as a mounting guide and a positioning member which are provided in the image forming apparatus main assembly. In the image forming apparatus main assembly, four process cartridges including the developing devices 4 accommodating toners of colors of yellow, magenta, cyan and black.

Then, particularly with reference to FIG. 1, an image forming operation of the image forming apparatus in this embodiment will be described. First, the charging roller 2 electrically charges the surface of the photosensitive drum 1 uniformly. Then, the surface of the photosensitive drum 1 is irradiated with laser light, on the basis of image information, emitted from the exposure device 3, so that an electrostatic latent image is formed on the photosensitive drum 1. Further, the developing roller 41 supplies the toner accommodated in the toner accommodating container 43 onto the photosensitive drum 1, so that the electrostatic latent image is developed and thus a toner image is formed on the photosensitive drum 1. Then, the toner image formed on the photosensitive drum 1 is primary-transferred onto the intermediary transfer belt 53 by the primary transfer roller 51. On the other hand, sheets of a sheet material S such as paper accommodated in a sheet feeding cassette 8 are separated and fed one by one by a sheet feeding roller 81. The fed sheet material S is conveyed to a secondary transfer roller 52 by a registration roller pair 82. Then, the toner image transferred on the sheet material S is heated and pressed in the fixing device 7 and thus is fixed on the sheet material S as a permanent image. Thereafter, the sheet material S is discharged to the outside of the image forming apparatus by a discharging roller pair 83.

Further, after the toner image is primary-transferred from the photosensitive drum 1 onto the intermediary transfer belt 53, the cleaning blade 61 of the cleaning device 6 removes the toner remaining on the photosensitive drum 1. Then, the removed toner drops into the residual toner container 62.

Embodiment 1

With reference to FIGS. 3 to 7, a toner accommodating container according to Embodiment 1 will be described. FIG.

Figure 4:
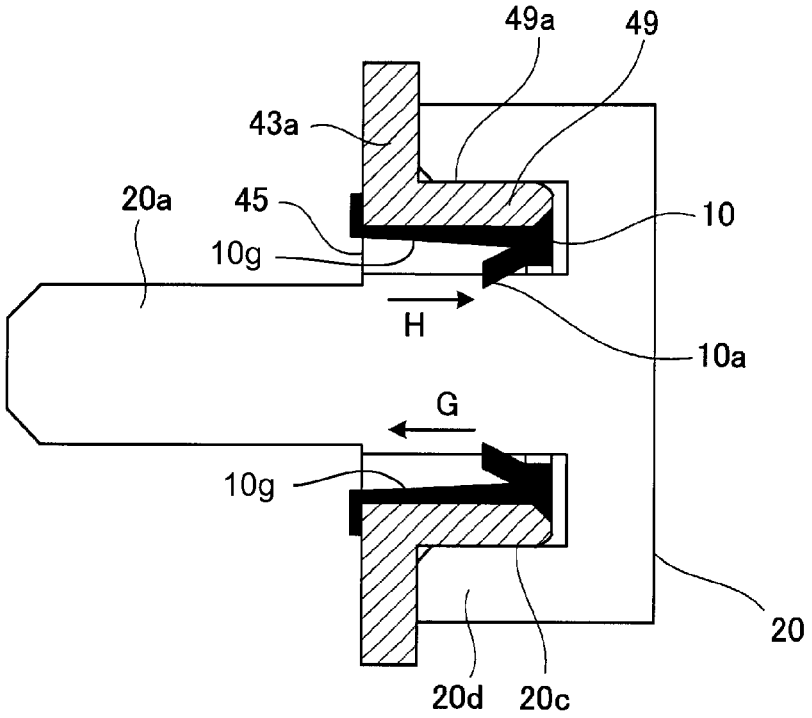
FIG. 4 is a schematic sectional view showing a seal structure in Embodiment 1.
Figure 5:
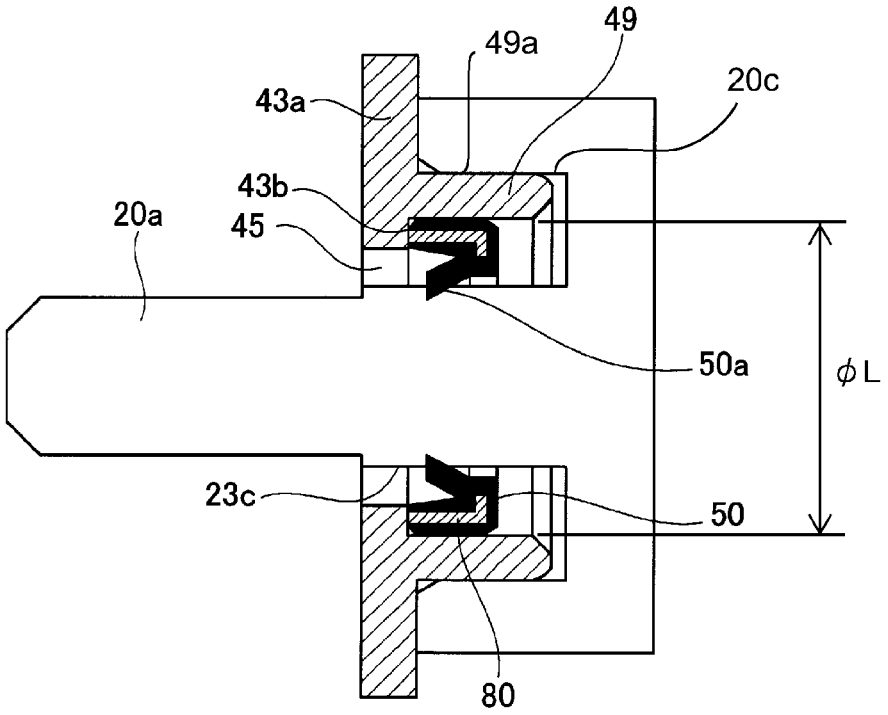
FIG. 5 is a schematic sectional view showing a seal structure in a conventional example.
Figure 6:
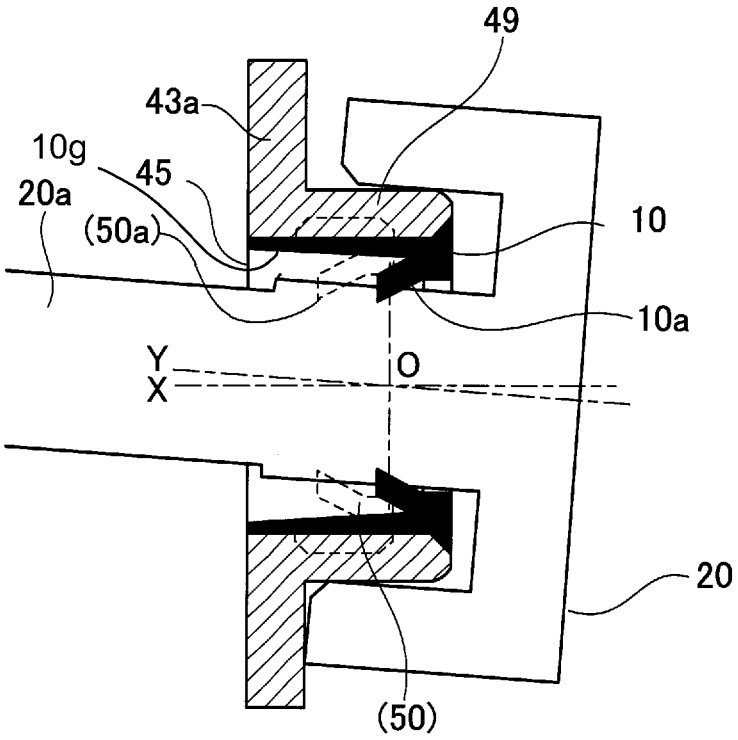
FIG. 6 is a schematic sectional view for illustrating a state in which a driving shaft is tilted.

3 is a schematic sectional view showing a structure of a developer accommodating container in Embodiment 1. FIG. 4 is a schematic sectional view showing a seal structure in Embodiment 1. FIG. 5 is a schematic sectional view showing a seal structure in a conventional example. FIG. 6 is a schematic sectional view for illustrating a state in which a driving shaft is tilted. Parts (a) and (b) of FIG. 7 are schematic sectional views each showing an example of a shape of a projected portion (lip portion) of a seal member.

Figure 3:
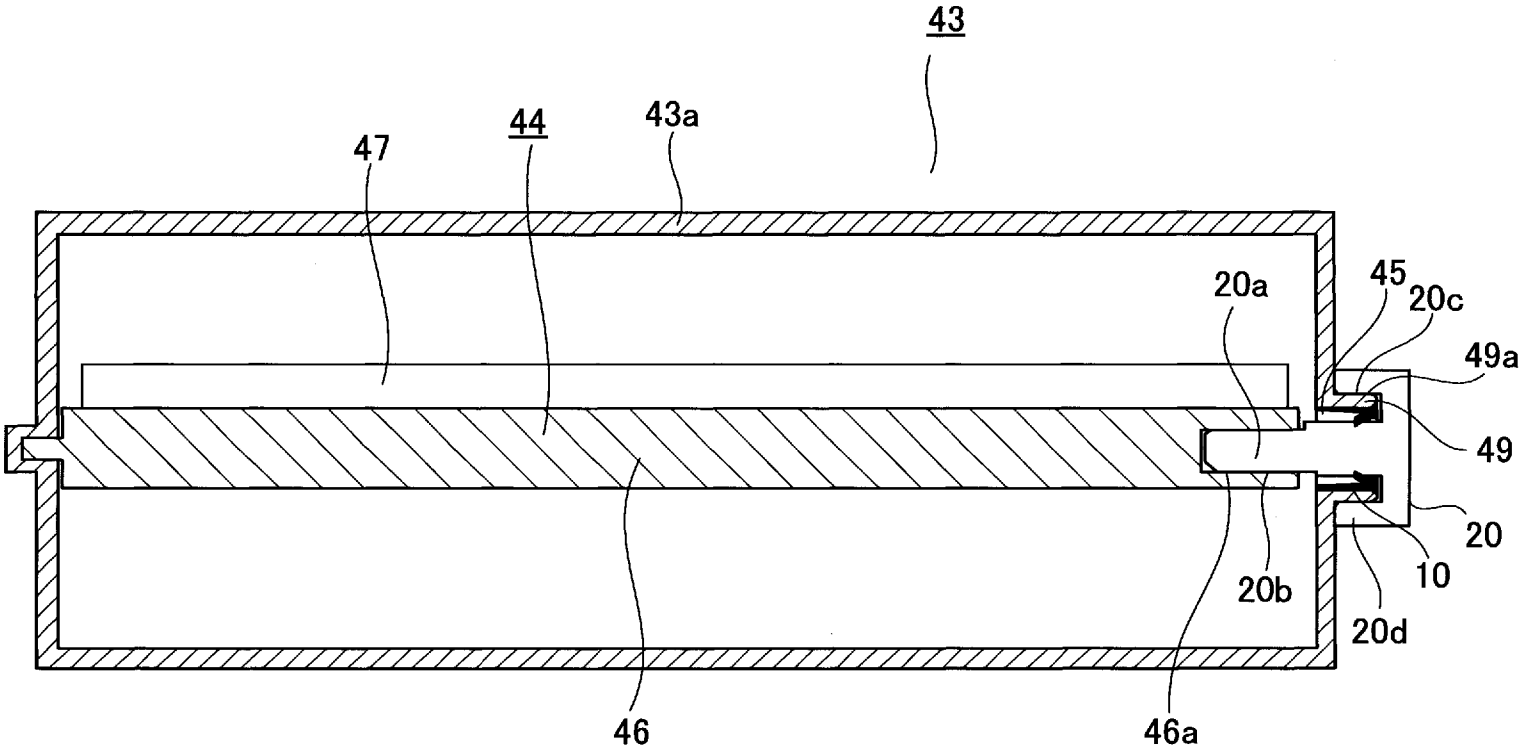
FIG. 3 is a schematic sectional view showing a structure of a developer accommodating container in Embodiment 1.

As shown in FIG. 3, with a frame 43*a* of the toner accommodating container 43, a driving member 20 as a rotatable member and a toner stirring unit 44 are assembled via a hole 45 provided in the frame 43*a*. The driving member 20 includes a driving shaft 20*a* as a rotatable member body portion which penetrates through the hole 45. The toner stirring unit 44 includes a rotation shaft 46 and a toner stirring sheet 47 provided on the rotation shaft 46. The rotation shaft 46 is held in the frame 43*a* of the toner accommodating container 43 by engaging an engaging portion 20*b* of the driving shaft 20*a* with a portion-to-be-engaged 46*a* provided at an end portion thereof.

Further, the frame 43*a* is provided with a cylindrical bearing portion 49 coaxially with the hole 45 so as to project toward the outside of the frame 43*a*. Further, the driving member 20 includes the driving shaft 20*a* as the rotatable member body portion and a cylindrical portion 20*d*, provided to be connected to an end portion of the driving shaft 20*a*, which slides on the bearing portion 49 at its inner peripheral surface contacted to an outer peripheral surface of the bearing portion 49. Then, a rotational driving force is transmitted to the toner stirring sheet 47 to stir and feed the toner accommodated in the toner accommodating container 43 onto the photosensitive drum 1. Further, in this embodiment, as a drive transmitting means to the driving member 20, gears (not shown) are used. As another drive transmitting means, a coupling having projections and recesses, or the like may also be used.

Next, with reference to FIG. 4, a seal structure as a feature of Embodiment 1 will be described. In some cases, the toner accommodated in the toner accommodating container 43 leaks to the outside of the frame 43*a* from a ring-like gap between the circumference of the hole 45 of the frame 43*a* and the outer peripheral surface of the driving shaft 20*a*. Therefore, in this embodiment, a ring-like seal member 10 is directly molded in an inner peripheral surface side of the cylindrical bearing portion 49 provided on the frame 43*a*. That is, a constitution in which the seal member 10 is integrally molded with the frame 43*a* is employed.

The seal member 10 includes a projected portion 10*a* slidably contacting the outer peripheral surface of the driving shaft 20*a*. The projected portion 10*a* projects from a base portion 10*g* contacting the circumference of the hole 45 of the frame 43*a*. The seal member 10 seals the ring-like gap between the frame 43*a* and the driving shaft 20*a* in the hole 45, so that the toner accommodated in the toner accommodating container 43 is prevented from leading out of the toner accommodating container 43. Incidentally, in this embodiment, the constitution in which the driving shaft 20*a* of the driving member 20 penetrates through the hole 45 is employed but a constitution in which the rotation shaft 46 of the toner stirring unit 44 penetrates through the hole 45 may also be employed. In this case, the seal member 10 seals the ring-like gap between the circumference of the hole 45 of the frame 43*a* and the rotation shaft 46. Further, the seal member 10 includes a retaining portion 10*c*, as a first preventing portion, provided in one end side thereof with respect to an axial direction and includes a retaining portion 10*d*, as a second preventing portion, provided in another end side thereof with respect to the axial direction. The retaining portions 10*c* and 10*h* are extended from the hole 45 toward an outside with respect to a radial direction, so that the seal member is prevented from moving in the axial direction of the hole 45 and thus is prevented from being detached from the hole 45.

In the constitution, in this embodiment, the seal member 10 is integrally formed by injection molding on the inner peripheral surface of the cylindrical bearing portion 49 provided on the frame 43*a*. Thus, by integrally forming the seal member 10 on the frame 43*a* by the injection molding, through a change in type of mold, position and shape of the photosensitive drum 10*a* of the seal member 10 can be freely adjusted.

In a conventional seal structure used for preventing the toner accommodated in the toner accommodating container 43 from leaking out of the frame 43*a*, as shown in FIG. 5, a hollow seal member 50 was press-fitted into the ring-like gap between the circumference of the hole 45 of the frame 43*a* and the driving shaft 20*a*. That is, the seal member 50 was not integrally molded with the frame 43*a*. In such a constitution, in order to prevent the hollow seal member 50 from being deformed during the press-fitting, a metal ring having high rigidity is engaged in the hollow seal member 50. For this reason, as an inner diameter $\phi 1$, of the bearing portion 49 into which the seal member 50 is press-fitted, there is a need to ensure an outer diameter for permitting insertion of the seal member 50 including the metal ring 80 and a press-fitting margin, thus resulting in an increase in size of the device. Further, in the case where a degree of the press-fitting of the seal member 50 with the inner peripheral surface of the bearing portion (projected portion) 49 is larger than a proper range, by deformation of the bearing portion 49, a degree of accuracy of engagement between in outer peripheral surface 49*a* of the bearing portion 49 and an inner peripheral surface 20*c* of the driving member 20 becomes poor. For that reason, there was a need to carefully control the press-fitting margin of the seal member 50.

Next, with reference to FIG. 6, shaft tilting (inclination) of the driving shaft 20*a* will be described while comparing Embodiment 1 and the conventional example. In FIG. 6, the seal member in Embodiment 1 is indicated by a solid line, and the seal member in the conventional example is indicated by a broken line. In Embodiment 1, the gears (not shown) are used for transmitting the driving force to the toner stirring member 47 via the driving member 20, so that by an engaging force between the gears, a force is exerted on the driving shaft 20*a* in a direction in which the driving shaft 20*a* is tilted (inclined) from the axial direction thereof in some cases. Further, in Embodiment 1, the driving member 20 and the frame 43*a* are formed of a resin material, and at a sliding portion between the inner peripheral surface 20*c* of the cylindrical portion 20*d* of the driving member 20 and the outer peripheral surface 49*a* of the bearing portion 49, a predetermined clearance is provided. Based on these factors, the driving shaft 20*a* is swung and tilted in some cases. When the driving shaft 20*a* is tilted, a penetration amount (depth) of the projected portion 10*a* of the seal member 10 with respect to the driving shaft cannot be kept at a constant level, so that a sealing property becomes unstable. Here, even in the case where the driving shaft 20*a* is tilted, when the projected portion 10*a* is disposed at a position closer to a swing center O to the possible extent so that the projected portion 10*a* and the driving shaft 20*a* can come into contact and slide with each other, it is possible to suppress instability of the penetration amount by the influence of the shaft tilting. In the constitution in which the toner seal is press-fitted as in the conventional example, the toner seal (member) 50 is abutted against an abutment surface 43*b*, of the frame 43*a*, which is an outer wall and is provided at a periphery of the hole 45, so that the position of the toner seal 50 with respect to the axial direction is determined (FIG. 5). It would be considered that the position of a projected portion 50*a* with respect to the axial direction is freely adjusted by increasing a thickness of the abutment surface 43*b* with respect to the axial direction, but when the thickness of the abutment portion 43*b* is increased, shrinkage cavity is liable to occur and therefore another problem such that the sealing property becomes unstable is caused.

As shown in FIG. 6, in the case where the driving shaft 20*a* is tilted from an axial center X before tilting, with an increasing distance from the swing center O (where an amount of displacement by the tilting is 0), an amount of displacement from the axial center X to an axial center Y after the tilting becomes larger. As shown in FIG. 6, in Embodiment 1, the projected portion 10*a* is molded so that it extends from the neighborhood of the end portion of the bearing portion 49 toward the inside of the frame 43*a*. For that reason, compared with the conventional example, the position where the projected portion 10*a* comes into contact and slide with the driving shaft 20*a* is disposed in the neighborhood of the swing center with respect to the axial direction of the axial center X. For this reason, in the seal structure in Embodiment 1, compared with the conventional example, it can be said that the penetration amount can be stably maintained and thus the sealing property is high. Incidentally, with respect to the axial direction of the axial center X, an ideal position of positions where the projected portion 10*a* can come into contact and slide with the driving shaft 20*a* is on the swing center O. In the case where the projected portion 10*a* is disposed at this position, even when the driving shaft 20*a* is tilted, the amount of penetration of the projected portion 10*a* with respect to the driving shaft 20*a* is not changed, so that it is possible to realize sealing with high stability.

In the conventional example, the toner seal is positioned and fixed by the press-fitting and therefore it was not able to be said that positional accuracy of the toner seal 50 and the projected portion 50*a* was not always sufficient. Further, in some cases, the toner seal 50 was press-fitted in a tilted state and therefore stability of a mounted state was low. In such a case, the position of the projected portion 50*a* relative to the frame 43*a* is largely deviated. As a result, the penetration amount of the projected portion 50*a* became unstable. On the other hand, according to Embodiment 1, the seal member 10 is integrally molded with the frame 43*a* and therefore the degree of accuracy of the positioning of the projected portion 10*a* relative to the frame 43*a* can be made very high. Therefore, the contact position of the projected portion 10*a* can be set with high accuracy, and as described above, the projected portion 10*a* is slidably contacted to the driving shaft 20*a* at the position closer to the swing center of the driving shaft 20*a*, so that the penetration amount can be stabilized even during use.

Next, shape and material of the seal member in this embodiment will be described. In this embodiment, from a viewpoint of the sealing property, a thickness of the projected portion 10*a* of the seal member 10 may preferably be 0.2 to 2.0 mm. Further, the shape of the projected portion 10*a* may be not only a single lip shape such that the projected portion 10*a* is contacted to the driving shaft 20*a* at one position with respect to the axial direction but also a shape such that plurality of projections and recesses are provided and contacted to the driving shaft 20*a* at a plurality of positions as shown in (a) of FIG. 7. Further, as shown in (b) of FIG. 7, the shape of the projected portion 10*a* may also be a shape such that the projected portion 10*a* follows the driving shaft 20*a* by an insertion operation of the driving shaft 20*a* into the hole 45 to effect double sealing.

As a material for the seal member 10, a material which has a type A hardness of about 30-80 degrees measured by a durometer in accordance with JIS-K6253 and does not readily cause permanent deformation may preferably be used, and the material may suitably have a compression set at 70 degrees of 50% or less. In this embodiment, as the material for the seal member 10, a thermoplastic elastomer resin material was used.

When the process cartridge is subjected to material recycling, there is a need to perform a step for physically separating the seal member 10 from the frame 43*a* of the toner accommodating container 43. By using, for the seal member 10, a material different in specific gravity from the resin material used for the frame 43*a*, the seal member 10 can be easily separated from the frame 43*a* by gravity classification. Further, when a base material of the resin material used for the frame 43*a* is the same as the material used for the seal member 10, the seal member 10 can be recycled together with the frame 43*a* without being separated with the frame 43*a*. For example, in the case where polystyrene or the like as a styrene-based resin material is used for the frame 43*a*, when a styrene-based elastomer resin material is used for the seal member 10, these materials can be recycled without separation. Further, in the case where urethane foam is used as the seal member 10, the urethane foam is used in a grease-applied state in order to impart a sliding property to a sliding portion between itself and the driving shaft 20*a* and in order to maintain the sealing property. In this case, there was a possibility of problems, depending on a viscosity of the grease, such as a variation in application amount and scattering of the grease due to inclusion of bubbles into a grease applying device. Therefore, in order to prevent the bubbles from entering the grease applying device, there was a need to carefully perform degassing (defoaming) treatment and control of the application amount. On the other hand, in this embodiment, by selecting a material having a good sliding characteristic with the driving shaft 20*a*, the sealing property can be maintained without using the grease at the sliding portion.

Next, with reference to FIGS. 8 to 10, a molding process of the seal member in this embodiment will be described. Parts (a) and (b) of FIG. 8 are schematic sectional views showing a state in which a molding metal mold is clamped on the toner accommodating container in this embodiment. Parts (a) and (b) of FIG. 9 are schematic sectional views showing the molding metal mold for the seal member. FIG. 10 is a schematic sectional view of the seal member stabilized in a molded state.

First, as shown in (a) of FIG. 8, clamping is effected with a predetermined force in a state in which the frame 43*a* is sandwiched between a first mold 70 provided outside the frame 43*a* of the toner accommodating container 43 and a second mold 71 provided outside the frame 43*a* of the toner accommodating container 43. In this embodiment, the frame 43*a* is positioned to the first mold 70 by an engaging portion 70*a*. The first mold 70 and the second mold 71 are positioned by an engaging portion 70*b* and a portion-to-be-engaged 71*b*. At this time, the first mold 70 contacts an end surface of the bearing portion 49 circumferentially, and the second mold 71 contacts an inner wall of the frame 43*a* circumferentially.

Next, as shown in (b) of FIG. 8, an injection nozzle 72 of the resin material injection device is contacted from the outside of the frame 43*a* to an injection port 70 placed in a clamped state. When the thermoplastic elastomer resin material for the seal member 10 is injected from the injection nozzle 72 in an arrow Y direction in (b) of FIG. 8, the resin material flows into a closed space formed by the frame 43*a* and the two molds 70 and 71. At this time, by injecting the resin material at predetermined pressure, a molding state is stabilized. Further, in an upstream side of the insertion direction of the driving shaft 20*a*, the seal member 10 is provided with a retaining portion 10*c* as a preventing portion having a larger diameter than an inner diameter of the frame 43*a* at the hole 45. As a result, the seal member 10 is prevented from dropping into the inside of the frame 43*a*. The retaining portion 10*c* may be formed on an inner wall surface of the frame 43*a* and may also be formed on both of inner wall surface and outer wall surface of the frame 43*a*. Incidentally, in the clamping of the molds, the first mold 70 and the second mold 71 may be engaged in a projection/recess state as shown in FIG. 8 and may also be engaged in a surface contact state as shown in (a) of FIG. 9. Further, as shown in (b) of FIG. 9, a part of the second mold 71 may be configured to be provided with elasticity (compliance) by a spring or the like. Further, as described above, by injecting the thermoplastic elastomer resin material for the seal member 10 from the inject nozzle 72 into the arrow Y direction in (b) of FIG. 8, the seal member 10 is provided with a gate portion 10*b*. As shown in (b) of FIG. 8, the gate portion 10*b* is configured to be disposed in a region where the retaining portion 10*c* is provided at the end surface of the base portion 10*g*, so that the seal member 10 can be downsized. That is, there is no need to increase a dimension of the base portion 10*g* itself correspondingly to a gate diameter ϕM of the injection nozzle 72.

Further, in this embodiment, the resin material is injected into the predetermined closed space at the predetermined pressure but as shown in FIG. 10, in the case where the resin material is injected in a certain amount, a terminal of a resin material flow path may be provided with an opening, from which an excessive resin material may be escaped as a buffer portion 10*d*. Thus, by providing the seal member 10 with the buffer portion 10*d* as a retaining portion (second preventing portion), the seal member 10 is prevented from dropping in an outward direction of the frame 43*a*.

As described above, in Embodiment 1, it is possible to suppress leakage, to the outside of the frame 43*a*, of the toner accommodated in the toner accommodating container 43 from the ring-like gap between the frame 43*a* and the driving shaft 20*a* in the hole 45. Further, in Embodiment 1, by integrally molding the seal member 10 with the frame 43*a* by the injection molding, stability of the penetration amount of the projected portion 10*a* with respect to the driving shaft 20*a* can be maintained and thus a high sealing property can be retained. Further, by setting the contact position of the projected portion 10*a* in the neighborhood of the swing center O of the driving shaft 20*a*, the penetration amount of the projected portion 10*a* with respect to the driving shaft 20*a* can be stabilized, so that destabilization of the seal member by shaft tilting of the driving shaft 20*a* can be suppressed. Further, in Embodiment 1, there is no need to use a ring-like metal member for the seal member 10 and therefore it is possible to realize a reduction in number of parts and downsizing of the developing device 4 and the cartridge including the developing device 4.

Embodiment 2

Embodiment 2 will be described with reference to FIGS. 11 and 12. FIG. 11 is a schematic sectional view showing a seal structure in this embodiment. In Embodiment 1, the constitution in which the seal member 10 is integrally molded with the frame 43*a* of the toner accommodating container 43 is employed. On the other hand, this embodiment is characterized by employing a constitution in which the seal member 10 is integrally molded with the driving shaft 20*a* of the driving member 20. Other constitutions and functions are the same as those in Embodiment 1 and therefore constituent elements identical to those in Embodiment 1 are represented by the same reference numerals or symbols and will be omitted from description.

As shown in FIG. 11, the seal member 10 is integrally molded on the driving shaft 20*a* as a rotatable member. The seal member 10 includes the base portion 10*g* hermetically contacted with the driving shaft 20*a* and the projected portion 10*a* projected from the base portion 10*g*. The projected portion 10*a* slidably contacts the inner peripheral surface of the cylindrical bearing portion 49 of the frame 43*a* of the toner accommodating container 43 while being curved with a certain penetration amount (depth).

Next, a seal member molding process in this embodiment will be described with reference to FIG. 12. First, a mold 80 is inserted from an arrow J direction in FIG. 12 and is abutted against the driving member 20. Then, an inject nozzle 82*a* of a resin material molding device is contacted to an injection port 80*c* provided on the driving member 20, and a melted thermoplastic elastomer resin material is injected from the injection nozzle 82*a*. The injected resin material passes through an injection path of the driving member 20 and flows into a space surrounded by the mold 80 and the driving member 20. The rotatable member entering the space move around the peripheral surface of the driving shaft 20 and then passes through a buffer path 10*f* provided at a position opposing the injection path with respect to an axial center, thus forming a buffer portion 10*e*. After the injection, the mold 80 is retracted in an arrow K direction in FIG. 12. By such a molding method, the seal member 10 can be integrally molded with the driving shaft 20*a*. Further, a part of the seal member 10 is formed in the injection path and the buffer path 10*f*, so that the seal member 10 is not readily disconnected from the driving member 20.

In Embodiment 2, it is possible to suppress leakage, to the outside of the frame 43*a*, of the toner accommodated in the toner accommodating container 43 from the ring-like gap between the frame 43*a* and the driving shaft 20*a* in the hole 45. Further, in Embodiment 2, by integrally molding the seal member 10 with the driving shaft 20*a* by the injection molding, stability of the penetration amount of the projected portion 10*a* with respect to the circumference of the hole 45 of the frame 43*a* can be maintained and thus a high sealing property can be retained. Further, by setting the sliding position of the projected portion 10*a* in the neighborhood of the swing center O of the driving shaft 20*a*, the penetration amount of the projected portion 10*a* with respect to the circumference of the hole 45 of the frame 43*a* can be stabilized, so that destabilization of the seal member by shaft tilting of the driving shaft 20*a* can be suppressed. In embodiment 2, the seal member 10 is integrally molded with the driving shaft 20*a* and therefore positioning of the projected portion 10*a* of the seal member 10 relative to the driving shaft 20*a* can be effected with high accuracy. Therefore, the sliding position of the projected portion 10*a* can be set in the neighborhood of the swing center O of the driving shaft 20*a* with high accuracy. Further, in Embodiment 2, there is no need to use a ring-like metal member for the seal member 10 and therefore it is possible to realize a reduction in number of parts and downsizing of the developing device 4 and the cartridge including the developing device 4.

Embodiment 3

With reference to FIGS. 13 to 15, a toner accommodating container according to Embodiment 3 will be described. FIG.

13 is a schematic sectional view showing a structure of a developer accommodating container in Embodiment 3. FIG. 14 is a schematic sectional view showing a seal structure in Embodiment 3. FIG. 15 is a schematic sectional view showing a seal structure before a driving shaft is inserted.

As shown in FIG. 13, with a frame 43*a* of the toner accommodating container 43, a driving member 20 and a toner stirring unit 44 are assembled via a hole 45 provided in the frame 43*a*. The driving member 20 includes a driving shaft 20*a* as a rotatable member body portion which penetrates through the hole 45. The toner stirring unit 44 includes a rotation shaft 46 and a toner stirring sheet 47 as a feeding member provided on the rotation shaft 46. The rotation shaft 46 is held in the frame 43*a* of the toner accommodating container 43 by engaging an engaging portion 20*b* of the driving shaft 20*a* with a portion-to-be-engaged 46*a* provided at an end portion thereof.

Further, the frame 43*a* is provided with a cylindrical bearing portion 49 coaxially with the hole 45. Further, the driving member 20 is provided so that an inner peripheral surface 20*c* of a cylindrical portion 20*d* provided on the driving member 20 slides on an outer peripheral surface 49*a* of the bearing portion 49. By employing such a constitution, a rotational driving force from the driving member 20 is transmitted to the toner stirring sheet 47 to stir and feed the toner accommodated in the toner accommodating container 43 onto the photosensitive drum 1.

Next, with reference to FIG. 14, the seal structure which is a feature of this embodiment will be described. As shown in FIG. 14, the seal member 10 which is a ring-like sealing member in this embodiment has a hollow cylindrical shape coaxial with the hole 45. The seal member 10 is fixed on the inner peripheral surface of the frame 43*a* at its outer peripheral surface in the hole 45 and is configured at its inner peripheral surface to slidably contact the outer peripheral surface of the driving shaft 20*a*. By such a constitution, in the case where the driving shaft 20*a* is rotated, the inner peripheral surface of the projected portion 10*a* as the contact portion comes into contact and slide with the outer peripheral surface of the driving shaft 20*a* of a shaft member to seal the ring-like gap between the circumference of the hole 45 of the frame 43*a* and the outer peripheral surface of the driving shaft 20*a*. As a result, the toner accommodated in the frame 43*a* is prevented from leaking out of the frame 43*a*. Incidentally, in this embodiment, the constitution in which the driving shaft 20*a* of the driving member 20 penetrates through the hole 45 is employed but a constitution in which the rotation shaft 46 of the toner stirring unit 44 penetrates through the hole 45 may also be employed. In this case, the seal member 10 seals the ring-like gap between the circumference of the hole 45 of the frame 43*a* and the rotation shaft 46.

Next, with reference to FIG. 15, the seal member 10 in this embodiment will be further described specifically. In a state in which the driving shaft 20*a* is not inserted into the hole 45 (in a state in which an external force is not exerted), the projected portion 10*a* of the seal member 10 is configured to be decreased in diameter as a whole from the inside toward the outside of the frame 43*a*. Further, in the inner peripheral surface side of the projected portion 10*a*, a helical projection (thread projection) 10*b* having an inclination angle θ with respect to the axis X of the driving shaft 20*a* is provided. Further, by this helical projection 10*b*, a helical groove is formed between projections. The projected portion 10*b* is a helical projection extending from the outside to the inside of the frame 43*a* when follows the driving shaft 20*a* with respect to the rotational direction. Here, an amount of curve in a diameter-increasing direction (a divergent amount of the projected portion 10*a* at an end portion) when the driving shaft 20*a* is inserted into the hole 45 at the projected portion 10*a* may preferably be set at 0.1-1.5 mm from the view points of the sealing property and a repelling force against the driving shaft 20*a*. Further, from the viewpoint of the molding property of the seal member 10, it is preferable that the projected portion 10*b* is 0.3-0.5 mm in pitch P, 0.2-0.6 mm in height H and 50-70 degrees in angle ϕ.

Thus, by providing the helical projection at the inner peripheral surface of the projected portion 10*a*, when the driving shaft 20*a* is rotated, the toner in the neighborhood of the projected portion 10*a* can be fed back toward the inside of the frame 43*a* (in the arrow Y1 direction in FIG. 14). Further, in the seal member 10 in this embodiment, by the helical grooves formed at the inner peripheral surface of the projected portion 10*a*, flow path connecting the outside and the inside of the frame 43*a* is ensured. Therefore, an inner pressure of the frame 43*a* can be always made equal to the ambient pressure. In other words, the inner pressure (air) of the frame 43*a* can be escaped from the inside to the outside of the frame 43*a*. That is, in this embodiment, the inner pressure (air) of the frame 43*a* can be escaped from the inside to the outside of the frame 43*a* while preventing the toner leakage.

Next, with reference to FIGS. 16 and 17, a molding process of the seal member in this embodiment will be described. FIG. 16 is a schematic sectional view showing a state in which an injection metal mold is clamped on the toner accommodating container in this embodiment. FIG. 17 is a schematic sectional view showing the seal member during molding. First, as shown in (a) of FIG. 8, clamping is effected in a state in which the frame 43*a* is sandwiched with a predetermined force between a first mold 70 provided outside the frame 43*a* of the toner accommodating container 43 and a second mold 71 provided outside the frame 43*a* of the toner accommodating container 43. In this embodiment, the frame 43*a* is positioned to the first mold 70 by an engaging portion 70*a*. Further, the first mold 70 contacts an end surface of the bearing portion 49 circumferentially, and the second mold 71 contacts an inner wall of the frame 43*a* circumferentially.

Next, as shown in FIG. 17, an injection nozzle 72 of the resin material injection device is contacted from the outside of the frame 43*a* to an injection port 70 placed in a clamped state. When the thermoplastic elastomer resin material for the seal member 10 is injected from the injection nozzle 72 in an arrow Y2 direction in FIG. 17, the resin material flows into a closed space 11 formed by the frame 43*a* and the two molds 70 and 71. At this time, by injecting the resin material at a constant pressure, a molding state is stabilized. At this time, the seal member 10 is provided with a gate portion 10*c* where the elastomer resin material is injected from the injection nozzle 72. The gate 10*c* is formed at a position different from the position of the projected portion 10*a*.

Next, with reference to FIG. 18, assembling between the toner stirring unit and the driving member will be described. FIG. 18 is an exploded perspective view showing a state in which the toner stirring unit and the driving member are assembled. As shown in FIG. 18, after the seal member 10 is molded, the toner stirring unit 44 in slid in an arrow Y3 direction, thus inserted to a predetermined position. Then, the driving member 20 is inserted in an arrow Y4 direction. Then, by engaging the engaging portion 20*b* of the driving shaft 20*a* into a portion-to-be-engaged 46*a* provided at an end of the rotation shaft 46 of the toner stirring unit 44, the toner stirring unit 44 is held in the toner accommodating container 43.

As described above, according to Embodiment 3, by the seal member 10, leakage of the developer (toner) can be prevented while permitting the escape of the inner pressure (air) of the frame 43*a* from the inside to the outside of the frame 43*a*. Therefore, different from the conventional example, there is no need to provide an air vent (hole) or a filter for covering the air vent in addition to the seal member for sealing the ring-like gap. Further, in the case where the conventional seal member formed with the urethane foam, as described above, a waste material by the pressing step is generated, but in the constitution in this embodiment, it is possible to eliminate the generation of the waste material.

Embodiment 4

With reference to FIG. 19, a residual toner container as a developer accommodating container according to Embodiment 4 will be described. FIG. 19 is a schematic sectional view showing the residual toner container in Embodiment 4. In embodiment 3, the constitution in the case where the seal member in the present invention is applied to the toner accommodating container 43 provided in the developing device 4 is described, but in this embodiment, a constitution in the case where the seal member is applied to a residual toner container 62 provided in the cleaning device 6 will be described. Further, the constitution is not limited to that in this embodiment but may also be applicable to a frame, for accommodating the toner, such as a toner cartridge for supplying the toner to the developing device.

As shown in FIG. 19, with a frame 62*a* of the residual toner container 62, a driving member 30 as a rotatable member and a residual toner feeding unit 63 are assembled via a hole 65 provided in the frame 62*a*. The driving member 30 includes a driving shaft 30*a* as a rotatable member body portion which penetrates through the hole 65. The residual toner feeding unit 63 includes a rotation shaft 66 and a residual toner feeding member 67 as a feeding member provided on the rotation shaft 66. The rotation shaft 66 is held in the frame 62*a* of the residual toner container 62 by engaging an engaging portion 30*b* of the driving shaft 30*a* with a portion-to-be-engaged 66*a* provided at an end portion thereof.

Further, the frame 62*a* is provided with a cylindrical bearing portion 69 coaxially with the hole 65. Further, the driving member 30 is 20*d* provided so that an inner peripheral surface 30*c* of a cylindrical portion 30*e* provided on the driving member 30 slides on an outer peripheral surface 69*a* of the bearing portion 69. By employing such a constitution, a rotational driving force from the driving member 30 is transmitted to the residual toner feeding member 67 to feed the toner accommodated in the residual toner container 62.

In order to seal a ring-like gap between the circumference of the hole of the frame 62*a* and the outer peripheral surface of the driving shaft 30*a*, the seal member 10 is used. The seal member 10 is directly formed on the frame 62*a* by molding, so that the seal member 10 and the frame 62*a* are integrally constituted. Other constitutions and functions in this embodiment are the same as those in Embodiments 1 and 2 and therefore will be omitted from description.

In Embodiment 4, it is possible to suppress leakage, to the outside of the frame 62*a*, of the toner accommodated in the residual toner container 62 from the ring-like gap between the frame 62*a* and the driving shaft 30*a* in the hole 65. Further, in this embodiment, by integrally molding the seal member 10 with the frame 62*a* by the injection molding, stability of the penetration amount of the projected portion 10*a* with respect to the driving shaft 30*a* can be maintained and thus a high sealing property can be retained. Further, by setting the contact position of the projected portion 10*a* in the neighborhood of the swing center O of the driving shaft 30*a*, the penetration amount of the projected portion 10*a* with respect to the driving shaft 30*a* can be stabilized, so that destabilization of the seal member by shaft tilting of the driving shaft 30*a* can be suppressed. Further, in this embodiment, there is no need to use a ring-like metal member for the seal member 10 and therefore it is possible to realize a reduction in number of parts and downsizing of the developing device 4 and the cartridge including the developing device 4.

Further, in Embodiment 4, similarly as in Embodiment 3, the seal member 10 may also be provided with the helical grooves.

Thus, by employing such a constitution, when the driving shaft 30*a* is rotated, the toner in the neighborhood of the projected portion 10*a* can be fed back toward the inside of the frame 62*a*. Further, in the seal member 10 in this embodiment, by the helical grooves formed at the inner peripheral surface of the projected portion 10*a*, flow path connecting the outside and the inside of the frame 62*a* is ensured. Therefore, an inner pressure of the frame 62*a* can be always made equal to the ambient pressure. In other words, the inner pressure (air) of the frame 62*a* can be escaped from the inside to the outside of the frame 62*a*. That is, in this embodiment, the inner pressure (air) of the frame 62*a* can be escaped from the inside to the outside of the frame 62*a* while preventing the toner leakage.

Example 5

With reference to FIGS. 20 to 22, a seal structure in Embodiment 5 will be described. Parts (a) and (b) of FIG. 20 are schematic views for illustrating the seal structure in this embodiment, in which (a) is a schematic sectional view of the seal structure, and (b) is a schematic perspective view of the seal structure. FIG. 21 is a schematic sectional view showing the seal structure in this embodiment. FIG. 22 is a schematic perspective view showing an example of the seal structure.

As described above, in the seal structure in Embodiment 1, the constitution in which the seal member 10 and the projected bearing portion 49 come in hermetical contact with each other at their peripheral surfaces is employed. In such a constitution, when the adhesive force is weak, the base portion 10*g* of the seal member 10 is separated from the projected bearing portion 49 in some cases since the adhesive force is lower than a sliding resistance between the lip portion 10*a* and the driving shaft 20*a*. Particularly, in the case where an engaging margin (amount) Z between the lip portion 10*a* and the driving shaft 20*a* is large in the case where the center axis of the driving shaft 20*a* is deviated, the sliding resistance is increased by e.g., an increase in strain force of the lip portion 10*a* against the driving shaft 20*a*, so that the seal member 10 is liable to be separated from the projected bearing portion 49. In order to solve this problem, in Embodiment 1, as a method for increasing the adhesive force between the seal member 10 and the projected bearing portion 49, selection and molding condition of the material were optimized.

On the other hand, in Embodiment 5, as shown in FIG. 20, a constitution in which grooves 49*b* are provided at a plurality of positions, so as to extend along a direction perpendicular to the rotational direction of the driving member 20, in a region where the seal member 10 is formed by molding on the inner peripheral surface of the projected bearing portion 49 (in the shaft hole) was employed. By such a constitution, when the resin material is injected as the material for the seal member 10, the resin material flows into the grooves 49*b*, so that a rotation preventing portion 10*j* projected from the base portion 10*g* toward the outside is formed. By this rotation preventing portion 10*j*, the adhesive force (drag) against the projected bearing portion 49 can be ensured, so that it is possible to suppress the separation of the seal member 10 from the projected bearing portion 49. Further, it is possible to suppress movement of the seal member 10, after being separated, together with the driving shaft 20*a*. Incidentally, the grooves 49*b* are not limited to those extending in the direction perpendicular to the rotational direction of the driving member 20 but may also be those extending in an oblique direction. Further, the structure of the rotation preventing portion 10*j* is not limited to the constitution in which the inner peripheral surface of the projected bearing portion 49 is provided with the grooves. Various shapes may also be employed so long as the structure has an uneven (projection/recess) shape capable of generating, between the seal member 10 and the projected bearing portion 49, a resisting force for suppressing the separation of the seal member 10 from the projected bearing portion 49 and the movement of the seal member 10 together with the driving shaft 20*a*. For example, a constitution in which the projection is provided so as to extend along the direction perpendicular or oblique to the rotational direction of the driving member 20 may also be employed. Further, it is also possible to employ a constitution in which a projection having a dimple shape, a boss-like shape, or the like is provided or a constitution in which the projected bearing portion 49 has an inner peripheral cross-section which is a polygonal cross-section, or the like constitution. Further, the uneven portion including the above-described grooves and projections is more effective with an increasing number of the grooves and projections, i.e., an increasing amount of a degree of unevenness. Further, the uneven portion may be disposed partly or entirely in a disposing region with respect to the axial direction of the projected bearing portion 49 but is effective when the uneven portion is disposed at least in the neighborhood of a base 10*a*1 of the lip portion.

Further, the seal member 10 is required to be formed by molding in a narrow region and therefore a gate diameter ϕM of the injection nozzle 72 is also limited to a small diameter.

Therefore, as shown in FIG. 21, positions of the grooves 49*b* and the gate portion 10 (injection portion of the seal member 10) are located in the same position as seen in the axial direction. That is, the injection nozzle 72 is disposed at a position where a width of the cylindrical seal member 10 is largest in a seal member-forming space. As a result, a large gate diameter ϕM can be ensured. For that reason, without losing a flowability of the resin material during injection, it is possible to sufficiently apply the inject pressure to the seal member 10, so that the adhesive force to the inner peripheral surface of the projected bearing portion 49 can be increased and also mold accuracy can be enhanced. Further, the constitution in which the gate portion 10*b* is disposed in the region where the rotation preventing portion 10*j* is provided at the end of the base portion 10*g* is employed, so that the seal member 10 can be downsized. That is, there is no need to separately form a portion where a width of the base portion 10*g* is increased correspondingly to the gate diameter ϕM or there is no need to increase the dimension of the base portion 10*g* itself corresponding to the gate diameter ϕM.

In Embodiment 5, the seal member 10 was configured to the integrally molded with the frame 43*a* of the toner accommodating container. However, as shown in FIG. 22, similarly as in Embodiment 2, a constitution in which the seal member 10 is integrally molded with the driving shaft 20*a* of the driving member 20 and in which grooves 20*e* are provided in a region where the seal member 10 is formed on the outer peripheral surface of the driving shaft 20*a* may also be employed. Other constitutions and functions are the same as those in Embodiments 1 to 3 and therefore will be omitted from description. Further, as a method for enhancing the adhesive force between the seal member 10 and the projected bearing portion 49, it is possible to use the same material as materials for the seal member 10 and the frame 43*a* (member-to-be-molded) or to increase a resin material temperature during the injection molding.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 245732/2011 filed Nov. 9, 2011; 245735/2011 filed Nov. 9, 2011; 271209/2011 filed Dec. 12, 2011, and 243708/2012 filed Nov. 5, 2012 which are hereby incorporated by reference.

What is claimed is:

1. A developer accommodating container for accommodating developer, said developer accommodating container comprising:

a frame provided with a hole;

a rotatable member penetrating the hole; and a seal member, provided on said frame by injection molding, for sealing a gap between a circumference of the hole of said frame and said rotatable member to prevent the developer from leaking out of said developer accommodating container, wherein said seal member includes a projected portion that projects toward an inside of the hole and contacts said rotatable member, wherein said frame includes a bearing portion that is a cylindrical portion projected from said frame and rotatably supports said rotatable member at an outer peripheral surface of said cylindrical portion, and wherein said seal member is provided on an inner peripheral surface of said cylindrical portion.

2. A developer accommodating container according to claim 1, wherein said seal member further includes a base portion, contacting the circumference of the hole, from which said projected portion projects.

3. A developer accommodating container according to claim 2, wherein said projected portion obliquely contacts said rotatable member with respect to an axial direction of said rotatable member.

4. A developer accommodating container according to claim 2, wherein said projected portion is helically formed on the circumference of the hole of said frame with respect to an axial direction of the hole.

5. A developer accommodating container according to claim 4, wherein said projected portion is formed to extend toward an inside of said developer accommodating container and follows said rotatable member with respect to a rotational direction of said rotatable member.

6. A developer accommodating container according to claim 1, wherein said seal member further includes a prevent portion for preventing movement of said seal member in an axial direction of the hole by being engaged with said frame.

7. A developer accommodating container according to claim 1, wherein said seal member further includes (i) a first preventing portion, provided in an end side of said seal member with respect to an axial direction of the hole, for preventing movement of said seal member in the axial direction by being engaged with said frame and (ii) a second preventing portion, provided in another end side of said seal member with respect to the axial direction, for preventing the movement of said seal member in the axial direction by being engaged with said frame.

8. A developer accommodating container according to claim 1, wherein said rotatable member is a feeding member for feeding the developer accommodated in said developer accommodating container.

9. A developer accommodating container according to claim 1, which accommodates developer used for developing an electrostatic latent image formed on a photosensitive member.

10. A developer accommodating container according to claim 1, which accommodates developer removed from a photosensitive member.

11. A developer accommodating container according to claim 1, wherein said rotatable member includes a sliding portion contacting said cylindrical portion.

12. A developer accommodating container according to claim 11, wherein said projected portion is disposed so as to overlap with said sliding portion with respect to a direction crossing an axial direction of the hole.

13. A developer accommodating container according to claim 1, wherein said rotatable member is a part of a unit for feeding the developer.

14. A developer accommodating container for accommodating developer, said developer accommodating container comprising:

a frame provided with a hole;

a rotatable member penetrating the hole; and a seal member, provided on said frame by injection molding, for sealing a gap between a circumference of the hole of said frame and said rotatable member to prevent the developer from leaking out of said developer accommodating container, wherein said seal member includes a projected portion which projects toward an inside of the hole and contacts said rotatable member, wherein said seal member further includes a prevent portion for preventing movement of said seal member in an axial direction of the hole by being engaged with said frame, and a gate portion, provided at said prevent portion, from which a resin material is to be injected when said seal member is formed on said frame by the injection molding.

15. A developer accommodating container for accommodating developer, said developer accommodating container comprising:

a frame provided with a hole;

a rotatable member penetrating the hole; and a seal member, provided on said frame by injection molding, for sealing a gap between a circumference of the hole of said frame and said rotatable member to prevent the developer from leaking out of said developer accommodating container, wherein said seal member includes a projected portion which projects toward an inside of the hole and contacts said rotatable member, wherein a contact position, where said projected portion contacts said rotatable member, with respect to an axial direction of the hole is set in the neighborhood of a swing center of said rotatable member when said rotatable member is swung by receiving a force exerted in a tiling direction from the axial direction under application of a driving force.

16. A developer accommodating container for accommodating developer, said developer accommodating container comprising:

a frame provided with a hole;

a rotatable member penetrating the hole; and a seal member, provided on said rotatable member by injection molding, for sealing a gap between a circumference of the hole of said frame and said rotatable member to prevent the developer from leaking out of said developer accommodating container, wherein said seal member includes a projected portion that projects from said rotatable member and contacts the circumference of the hole of said frame.

17. A developer accommodating container according to claim 16, wherein said frame includes a bearing portion for rotatably supporting said rotatable member.

18. A developer accommodating container according to claim 17, wherein said bearing portion is a cylindrical portion projected from said frame and rotatably supports said rotatable member at an outer peripheral surface of said cylindrical portion, and wherein said seal member contacts an inner peripheral surface of said cylindrical portion.

19. A developer accommodating container according to claim 16, wherein said projected portion obliquely contacts the circumference of the hole of said frame with respect to an axial direction of said rotatable member.

20. A developer accommodating container according to claim 16, wherein said rotatable member is a feeding member for feeding the developer accommodated in said developer accommodating container.

21. A developer accommodating container according to claim 16, which accommodates developer used for developing an electrostatic latent image formed on a photosensitive member.

22. A developer accommodating container according to claim 16, which accommodates developer removed from a photosensitive member.

23. A developer accommodating container according to claim 16, wherein said rotatable member includes a sliding portion contacting said cylindrical portion.

24. A developer accommodating container according to claim 23, wherein said projected portion is disposed so as to overlap with said sliding portion with respect to a direction crossing an axial direction of the hole.

25. A developer accommodating container according to claim 16, wherein said rotatable member is a part of a unit for feeding the developer.

26. A process cartridge detachably mountable to an image forming apparatus, said process cartridge comprising:

(i) a photosensitive member;

(ii) a developing member for developing an electrostatic latent image formed on said photosensitive member with developer; and (iii) a developer accommodating container for accommodating the developer, said developer accommodating container comprising:

a frame provided with a hole;

a rotatable member penetrating the hole; and a seal member, provided on said frame by injection molding, for sealing a gap between a circumference of the hole of said frame and said rotatable member to prevent the developer from leaking out of said developer accommodating container, wherein said seal member includes a projected portion that projects toward an inside of the hole and contacts said rotatable member, wherein said frame includes a bearing portion that is a cylindrical portion projected from said frame and rotatably supports said rotatable member at an outer peripheral surface of said cylindrical portion, and wherein said seal member is provided on an inner peripheral surface of said cylindrical portion.

27. A process cartridge according to claim 26, wherein said rotatable member includes a sliding portion contacting said cylindrical portion.

28. A process cartridge according to claim 27, wherein said projected portion is disposed so as to overlap with said sliding portion with respect to a direction crossing an axial direction of the hole.

29. A process cartridge according to claim 26, wherein said rotatable member is a part of a unit for feeding the developer.

30. A process cartridge detachably mountable to an image forming apparatus, said process cartridge comprising:

(i) a photosensitive member;

(ii) a developing member for developing an electrostatic latent image, formed on said photosensitive member, with developer; and (iii) a developer accommodating container for accommodating the developer, said developer accommodating container comprising:

a frame provided with a hole;

a rotatable member penetrating the hole; and a seal member, provided on said rotatable member by injection molding, for sealing a gap between a circumference of the hole of said frame and said rotatable member to prevent the developer from leaking out of said developer accommodating container, wherein said seal member includes a projected portion that projects from said rotatable member and contacts the circumference of the hole of said frame.

31. A process cartridge according to claim 30, wherein said rotatable member includes a sliding portion contacting said cylindrical portion.

32. A process cartridge according to claim 31, wherein said projected portion is disposed so as to overlap with said sliding portion with respect to a direction crossing an axial direction of the hole.

33. A process cartridge according to claim 30, wherein said rotatable member is a part of a unit for feeding the developer.

* * * * *